US006319657B1

(12) United States Patent
Hirabayashi

(10) Patent No.: US 6,319,657 B1
(45) Date of Patent: Nov. 20, 2001

(54) IMAGE FORMING METHOD OF PHOTOTHERMOGRAPHIC MATERIAL

(75) Inventor: Kazuhiko Hirabayashi, Hino (JP)

(73) Assignee: Konica Corporation (JP)

( * ) Notice: Subject to any disclaimer, the term of this patent is extended or adjusted under 35 U.S.C. 154(b) by 0 days.

(21) Appl. No.: 09/523,266

(22) Filed: Mar. 10, 2000

(30) Foreign Application Priority Data

Mar. 16, 1999 (JP) ..... 11-070311

(51) Int. Cl.[7] ..... G03C 1/498
(52) U.S. Cl. ..... 430/350; 430/531; 430/619
(58) Field of Search ..... 430/350, 619, 430/531

(56) References Cited

U.S. PATENT DOCUMENTS 4,076,532 * 2/1978 Gottermeier .
5,311,259 5/1994 Moriya et al. .

FOREIGN PATENT DOCUMENTS 0803766 10/1997 (EP) .
1010676 1/1998 (EP) .
0899613 3/1999 (EP) .

OTHER PUBLICATIONS

European Search Report EP 00 30 2090.

* cited by examiner

*Primary Examiner*—Thorl Chea
(74) *Attorney, Agent, or Firm*—Jordan B. Bierman; Bierman, Muserlian and Lucas

(57) ABSTRACT

An image forming method is disclosed, comprising the steps of processing image data or setting an exposure condition so that an image size is enlarged or reduced, imagewise exposing a photothermographic material to laser to form an image enlarged or reduced based on the processed image data or the set exposure condition, and subjecting the exposed photothermographic material to thermal development, in which the photothermographic material comprises an organic silver salt, a photosensitive silver halide, a reducing agent, and a contrast increasing agent or a quaternary onium salt.

6 Claims, 1 Drawing Sheet

IMAGE FORMING METHOD OF PHOTOTHERMOGRAPHIC MATERIAL

FIELD OF THE INVENTION

The present invention relates to an image forming method by use of photothermographic materials for use in printing and in particular to a method of adjusting an exposure area with respect to deformation in size of a photothermographic material upon thermal development to minimize deformation of image sizes.

Further, the present invention relates to a method of adjusting an exposure area in response to characteristics of thermal development portions to minimize deformation in image size.

BACKGROUND OF THE INVENTION

Plate-making has undergone a marked change from manual working to electronic stripping during the last few years. Along with such trends, use of plotters such as an image setter are rapidly spreading. A processor of conventional silver salt photographic materials is now commonly connected on line to such precision instruments, producing problems such a corrosion of the substrate or troubles of expensive instruments, which increasingly occur due to gas or moisture released from the processing solutions in the processor.

In conventional silver salt photographic materials, such works that plumbing for diluting the developer and fixer, as well as for washing is needed and effluents which have to be recovered by recyclers take a lot of time and labor, so that introduction of a water-free dry processing system is strongly desired. Among current dry systems, thermal processing using thermally developable photothermographic materials is currently most suitable for practical use in terms of manufacturing cost and performance.

However, the photothermographic materials are often processed at a temperature higher than the glass transition temperature of the support so that the photothermographic materials are often deformed due to elongation or shrinkage after being processed, producing problems such that images on the photothermographic material are not reproduced in the intended dimension due to elongation or shrinkage of the support. Accordingly, when applied to color printing, difference in dimension between separation negatives (or positives) occurs, producing doubling on prints.

Attempts for improving dimensional stability have been proposed. JP-A 61-235608 and 3-275332 (herein, the term, JP-A means an unexamined and published Japanese Patent Application), for example, describes a method of relaxation after thermal fixing during the stage of casting of the base substrate. The support is often subbed, but subbing adversely enhances thermal shrinkage so that a more reliable method is eagerly sought. JP-A 10-10676 and 10-10677 describe a thermal treatment after casting of the base substrate. However, its reproducibility was insufficient and when applied to color printing, it still causes doubling due to differences in dimension between separation negatives and is therefore unacceptable in practice.

Further, thermal processing of photothermographic materials results in other problems. A thermal developing section often produces temperature unevenness in its interior. On the other hand, the photothermographic material easily causes uneven development even when the temperature difference is only ±1° C. Accordingly, image sizes or halftone dot sizes vary locally with temperature unevenness inside the thermal developing section, leading to uneven development. As a result, suitable images cannot often be reliably obtained. As a result of the inventor's study, it was proved that problems concerning the image size were often produced when photothermographic materials were subjected to thermal development. Such problems concerning the image size cause doubling in the field of printing, in which plural photographic materials are overlapped, leading serious problems.

SUMMARY OF THE INVENTION

Accordingly, an object of the present invention is to solve various problems relating to the image size and produced when photothermographic materials for use in printing are subjected to thermal processing (or development). Thus, it is an object of the invention to provide a method of image formation by using a photothermographic material without producing changes in image size, which often cause doubling even when the dimensional change of the photothermographic material occurs upon thermal development and also to provide an image forming apparatus by application thereof.

Further, it is an object of the invention to provide an image forming method by using a photothermographic material and an image forming apparatus, thereby reducing uneven development caused by temperature unevenness in the interior of a thermal developing section or uneven development produced in response to characteristics of the thermal developing section.

The above objects of the invention can be accomplished by the following constitutions:

1. An image forming method comprising the steps of:
   - processing image data or setting an exposure condition so that an image is enlarged or reduced,
   - imagewise exposing a photothermographic material to laser to form an image size enlarged or reduced based on the processed image data or the set exposure condition, and
   - subjecting the exposed photothermographic material to thermal development,
   - wherein the photothermographic material comprises an organic silver salt, a photosensitive silver halide, a reducing agent, and a contrast increasing agent or a quaternary onium salt;
2. The image forming method described in 1. above, wherein the image size is enlarged or reduced to compensate for dimensional change of the photothermographic material before and after being subjected to thermal development;
3. The image forming method described in 1. above, wherein the image size is enlarged or reduced corresponding to characteristics of a thermal developing section;
4. The image forming method described in 1. above, wherein the photothermographic material has a 110 to 150 $\mu$m thick support;
5. The image forming method described in 1. above, wherein the photothermographic material has a support, the support being allowed to stand for at least 30 seconds in an atmosphere at a temperature of not less than a glass transition temperature of the support (Tg) and not more than Tg plus 100° C. after being cast and stretched and before being exposed;
6. The image forming method described in 1. above, wherein the processing temperature in the thermal developing section is from 100 to 150° C., and a ratio of a contact length in a transporting direction of the photothermographic material with rollers (rs) to a path length of the thermal developing section (ps), rs/ps is 0.04 to 1.4;

7. The image forming method described in 1. above, wherein the image size is enlarged or reduced at a level of −0.01 to 0.1%;

8. An image forming apparatus used for a photothermographic material comprising:

an image data processing section to process image data or an exposure condition setting section to set an exposure so that an image size is enlarged or reduced to compensate for a dimensional change of the photothermographic material before and after being subjected to thermal development, condition, an exposure section to imagewise expose the photothermographic material to laser based on the processed image data or the set exposure condition, and a thermal development section to subject the photothermographic material to thermal development;

9. An image forming apparatus used for a photothermographic material comprising:

an image data processing section to process image data or an exposure condition setting section to set an exposure so that an image size is enlarged or reduced to correspond to characteristics of a thermal development section, an exposure section to imagewise expose the photothermographic material to laser based on the processed image data or the set exposure condition; and a thermal development section to subject the photothermographic material to thermal development;

10. An image forming method of a photothermographic material comprising the steps of:

subjecting a photothermographic material comprising on a support an organic salt, a photosensitive silver halide, reducing agent, and a hydrazine derivative or quaternary onium salt to scanning exposure by an exposure apparatus having an image processing section to subject an image digital data to an enlarging or reducing treatment and a scanning exposure section to conduct scanning exposure by laser, and subjecting the photothermographic material to thermal development;

11. An image forming method of a photothermographic material comprising the steps of:

subjecting the photothermographic material to scanning exposure by an exposure apparatus having an image processing section to conduct an image enlarging or reducing treatment so as to meet a dimensional change before and after thermal development of the photothermographic material, and subjecting the photothermographic material to thermal development;

12. The image forming method described in 10. or 11. above, wherein the support has a thickness of 110 to 150 $\mu$m;

13. The image forming method described in 10., 11. or 12. above, wherein the support is allowed to stand for at least 30 seconds in an atmosphere of a temperature of not less than a glass transition temperature of the support (Tg) and not more than Tg plus 100° C after being cast and stretched but before being exposed;

14. The image forming method described in 10., 11., 12. or 13. above, wherein the processing temperature in a thermal developing section is not less than 100° C. and not more than 150° C., and a ratio of a contact length with a roller in the thermal developing section (rs) to a path length in the developing section (ps), rs/ps meets the following requirement:

$$0.04 \leq rs/ps \leq 1.4.$$

DETAILED DESCRIPTION OF THE INVENTION

Figure 1:
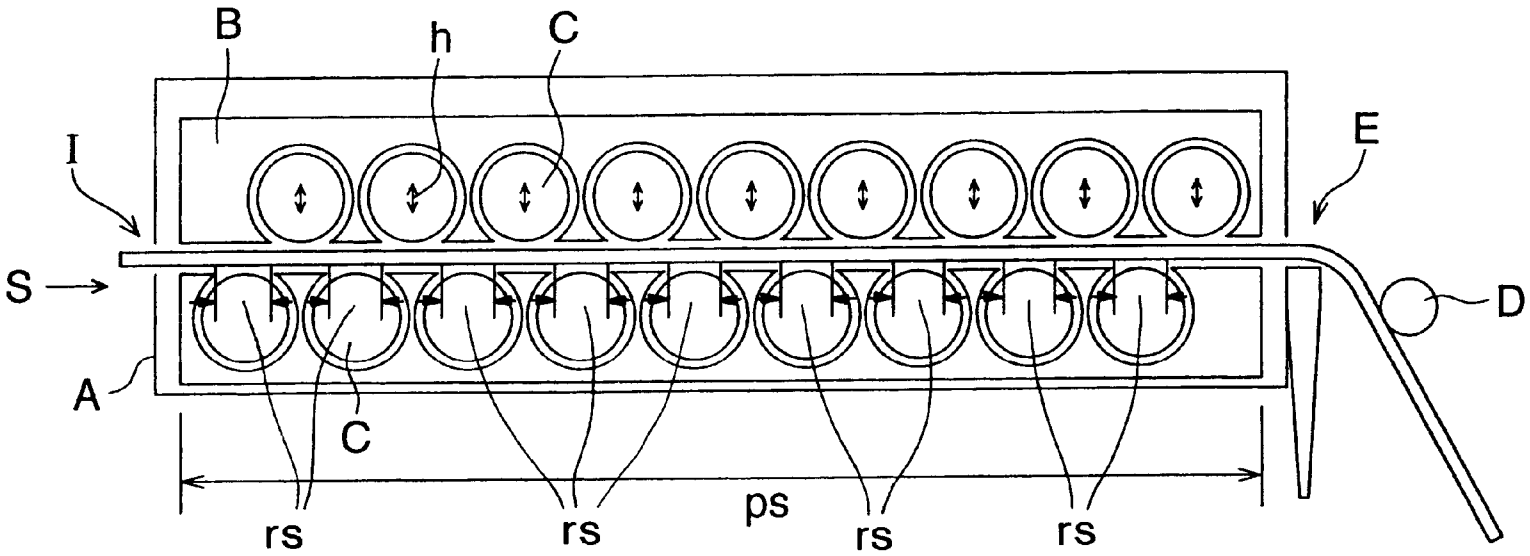
FIG. 1 illustrates a sectional view of a thermal developing machine used in the invention.

The change of image size is due mainly to properties of the support. Photographic materials used for lithographic printing mainly employ a thermally stretched polyethylene terephthalate base (hereinafter, referred to as PET). Thus, the main cause is attributed to the fact that after the base is subbed and further thereon coated with component layers of a photothermographic material and further when subjected to exposure and thermal development, the stretched PET base is subjected to thermal relaxation and shrinks.

In principle, it is impossible to completely avoid the thermal relaxation of the stretched PET base. In the invention, the size of the photothermographic material is measured in advance of thermal development and after being subjected to thermal development, the size of the photothermographic material is measured again. Using the measurement data, the degree of shrinkage of the photothermographic material due to thermal development is determined. Based on this data, the image size is calculated in the image processing section and a laser scanning exposure region is calculated, followed by exposure.

However, in cases where component units of the photothermographic material are different in the degree of elongation or shrinkage or in cases where the degree of elongation or shrinkage is locally different in a roll photothermographic material, it is difficult to accurately correct for the image size. To definitely achieve the method described above, therefore, it is necessary to allow the shrinkage of the PET base or the photothermographic material to be as small as possible and the use of means for keeping the degree of elongation or shrinkage constant is also needed.

To enlarge or reduce the image size, the exposed image size is determined taking into account the dimensional change of the photothermographic material, caused by thermal development. Thus, it is necessary to set the exposure condition that in cases where a photothermographic material thermally shrinks, an exposed image size is enlarged so as to match its shrinkage so that the final image size after development remains unchanged. To achieve this, the degree of shrinkage of the photothermographic material due to thermal development is determined in advance.

Enlargement or reduction of the exposed image size includes a method of processing image data and also a method of setting exposure conditions. To process the image data, the image itself may be enlarged or reduced but it is preferred that the image data be converted to halftone dot data and the number of picture elements constituting halftone dots is increased or decreased to enlarge or reduce the image size. The enlargement or reduction of the image size includes the overall image or the halftone dots alone. Thus, the entire image may be enlarged or reduced by enlarging or reducing the halftone dots; or alternatively, only halftone dots are enlarged or reduced and the image itself may not be enlarged or reduced. As a method of setting the exposure condition, for example, in the case of an exposure apparatus (such as a plotter) in which a photothermographic material is wound around the external periphery of a drum and exposure is conducted while rotating the drum, enlargement or reduction of the image size in the main-scanning direction is achieved by adjusting the number of rotations of the drum. In the case of an exposure apparatus in which a photothermographic material is wound against the internal periphery of the drum is exposed with rotating a mirror, enlargement or reduction of the image size in the main-scanning direction is achieved by adjusting the number of rotations of the mirror. Further, enlargement or reduction of the image size in the sub-scanning direction is conducted by adjusting the laser scanning speed with adjusting the rate of a stepping motor.

In cases where the rate of enlargement or reduction is different between vertical and horizontal directions, it is preferred that the image date is subjected to affine transformation to conduct the image size enlargement or reduction, as described below.

The enlargement or reduction of the exposed image size is to enlarge or reduce the image size, based on the image data inputted to an image forming apparatus. Thus, it is based on the image data without taking into account an image size change due to thermal development.

Since the image size change due to thermal development is small, it is preferred that the image size enlargement or reduction be conducted in an order of 0.01 to 0.1% to make an accurate correction of the image size. Further, in cases when the developing temperature is higher than the glass transition temperature (Tg), effects of the invention are marked and more marked in cases of being higher than Tg plus 20° C.

Specifically, correction is made geometrically as follows: plural dots, used as a reference are recorded on a photothermographic material, their variations due to elongation or shrinkage after thermal development are measured and based thereon a conversion is made. Thus, as the simplest method, reference dots are set at plural intervals and the interval between reference dots is measured after thermal development to determine the degree of shrinkage. These data are inputted to make conversion thereof to determine the exposure size. Usually, it is conducted in a rather simple manner in which only some of intervals of a few plural dots are measured before and after development to determine a degree of shrinkage and the thus obtained data is provided to an image processing section with built-in software to convert the distance in the scanning direction and a distance in the direction vertical thereto according to the degree of shrinkage. Based thereon can be obtained an image forming method whereby reduced variation in image size caused by thermal development of the photothermographic material is achieved.

Known as a more precise transforming method is an affine transformation treatment, in which many reference dots are set and coefficients of an affine transformation function are determined so that when the dots are photographed, the sum of the square of residual difference between a real dot and photographed dot is minimized, and using the thus determined coefficient, a geometrical correction, i.e., transformation of data arrangement angle or magnification is made.

Applying such processing, when a photothermographic material elongates or shrinks in the thermal developing section, between before and after development, an exposed image is allowed to be reduced or enlarged according to a degree of elongation or shrinkage. Even if the dimension of the photothermographic material itself changes between before and after development, an imaging area returns its original.

After making such a correction of an exposed area, the photothermographic material, in sheet or roll, form is transported to a thermal developing machine or thermal developing section having a heated roller or a heated drum to undergo thermal development. The thermal developing section may be either a thermal developing machine separately provided or one with a built-in scanning exposure machine, such as a laser image setter having a thermal developing section.

With respect to the data regarding a change in image size between before and after thermal development of a photothermographic material, the photothermographic material is thermally developed, a change in size of the developed photothermographic material is measured and the measurement values are inputted to an image forming apparatus, in which the imagewise-exposed image size is enlarged or reduced based on the measured value inputted. Alternatively, the thermal developing section, which is provided with an image size detector, provides feedback of the detected result of the image size to an image data processing section or an exposure condition setting section for each development, followed by enlargement or reduction of the imagewise-exposed size of the photothermographic material. The data regarding the change in image size accompanying thermal development is inputted for each kind of a photothermographic material and the operator needs to only input the kind of the photothermographic material, thereby automatically executing enlargement or reduction for the image size.

It is preferred to reduce the degree of elongation or shrinkage and also to make it constant, thereby lessening any fluctuation between photothermographic material sheets or between developing lots. A marked difference in degree of elongation or shrinkage between developing lots or photothermographic materials increases the number of necessary corrections, which is unacceptable in practical use. To reduce thermal elongation or shrinkage of a photothermographic material or to keep it constant, it is preferred to employ the following means. Thus, in the preparation of a PET base used as a support of photothermographic material, the PET base is allowed to stand under an environment at a temperature of not less than the glass transition temperature of the PET base (Tg) and not more than Tg plus 100° C. for at least 30 seconds after the casting and stretching stage but before exposure, leading to thermal relaxation and thereby enhancing dimensional reproducibility after processing. A temperature of not less than the glass transition temperature of the PET base (denoted as Tg) and not more than Tg plus 70° C. is more preferred. A temperature lower than Tg produces no effect and a temperature higher than Tg plus 100° C. produces marked deformation of the support.

The support used in the invention is preferably 110 to 150 μm thick, and more preferably 110 to 130 μm thick. When the support is too thin, marked deformation thereof occurs during thermal development, and too thick a support often produces transportation troubles in the thermal developing section.

The thermal developing conditions relate to elongation or shrinkage of a photothermographic material. The processing temperature in the thermal developing section is preferably 100 to 150° C., and more preferably 105 to 130° C. Development is insufficient at a temperature of less than 100° C., and at a temperature of more than 150° C., unexposed areas blacken, making it difficult to control the development.

Further, to uniformly heat the photothermographic material, it is preferred that the ratio of a contact length, in the transporting direction, with roller(s) (denoted as "rs") to a path length in the thermal developing section (denoted as "ps"), rs/ps is preferably $0.04 \leqq rs/ps \leqq 1.4$, and more preferably $0.10 \leqq rs/ps \leqq 1.0$. When the contact length is too short, heat transferred from the roller is too little in the prescribed developing time, leading to insufficient development. On the contrary, when the contact length is too long, contact with many rollers at a high temperature produces curling or resulting in non-uniform stress to the photothermographic material (e.g., by tension at the time of transportation), deteriorating reproducibility of elongation or shrinkage. Herein, the path length in the thermal developing section is defined as the distance between the inlet portion and the outlet portion in the thermal developing section. The contact length is defined as the length in contact with the heated roller(s) or heated drum(s); in cases where being in contact with a single roller, for example, the contact length can be determined from the carrying-in and carrying-out angles; and in cases where being transported by plural heated rollers, the contact length can be determined from the roller diameter, the distance between rollers, the thickness of the photothermographic material, etc.

A change in image size is also sometimes caused by characteristics of the thermal developing section. In this case, the image size change often occurs locally. For example, the image size or the halftone dot size of a photothermographic material occurs locally due to non-uniformity in temperature inside the thermal developing section, resulting in unacceptable images. In the invention, such non-uniformity in development can be reduced by image enlargement or reduction processing. In cases when the temperature at the edge portions in the thermal developing section is lower than that in the central portion, for example, the image size (i.e., being either the size of an image itself or the halftone dot size) at the edge portion is made larger than that in the central portion. On the contrary, in cases of being higher at the edge portion, the image size at the edge portion is made smaller. In this case, a change in image size of a photothermographic, caused by characteristics of the thermal developing section such as non-uniformity in temperature, is measured, after which the measured change in image size is inputted in advance and an image size enlargement or reduction is executed so as to make correction of the inputted change value. The image size enlargement or reduction may be for the entire image or a local area of the image. The image enlargement or reduction may employ the method described above.

With respect to the data regarding a change in image size, which is due to characteristics of the thermal developing section, the photothermographic material is thermally developed, a change in size of the developed photothermographic material is measured and the measurement values are inputted to an image forming apparatus, in which the imagewise-exposed image size is enlarged or reduced based on the measured value inputted. Alternatively, the thermal developing section, which is provided with an image size detector, provides feedback of the detected result of the image size to an image data processing section or an exposure condition setting section for each development, followed by enlargement or reduction of the imagewise-exposed size of the photothermographic material. The data regarding the change in image size accompanying thermal development is inputted for each kind of photothermographic material and an operator needs to only input the kind of the photothermographic material, thereby automatically executing enlargement or reduction of the image size.

In cases when plural plates such as yellow (Y), magenta (M), cyan (C) and black (K) plates (or a Y, M and C, or black and red) are superposed to form color images, effects of the present invention are marked in photothermographic materials which are employed for the printing plates.

The photothermographic material used in the invention is a thermally developable photographic material, which comprises on a support an organic silver salt, a photosensitive silver halide, a reducing agent, and a hydrazine derivative or quaternary onium salt. The photothermographic material used in the invention forms photographic images upon thermal development. In addition to the constituting components described above, a tone modifier to improve silver image tone may be optionally incorporated. The photothermographic material is stable at ordinary temperatures and after exposure, heating at a high temperature (e.g., 80 to 140° C.) causes solution physical development in the photosensitive layer by catalytic action of a latent image produced in exposed silver halide grains, in which the organic silver salt is reduced by the reducing agent to form metallic silver images. This reaction proceeds without supplying an aqueous processing solution such as water. These techniques are described a number of literatures. The constituting components of the photothermographic material used in the invention will be further described.

Photosensitive silver halide emulsions usable in the thermally developable photosensitive materials according to the invention can be prepared according to the methods commonly known in the photographic art, such as single jet or double jet addition, or ammoniacal, neutral or acidic precipitation. Thus, the silver halide emulsion is prepared in advance and then the emulsion is mixed with other components of the invention to be incorporated into the composition used in the invention. To sufficiently bring the photosensitive silver halide into contact with an organic silver salt, there can be applied such techniques that polymers other than gelatin, such as polyvinyl acetal are employed as a protective colloid in the formation of photosensitive silver halide, as described in U.S. Pat. Nos. 3,706,564, 3,706,565, 3,713,833 and 3,748,143, British Patent 1,362,970; gelatin contained in a photosensitive silver halide emulsion is degraded with an enzyme, as described in British Patent 1,354,186; or photosensitive silver halide grains are prepared in the presence of a surfactant to save the use of a protective polymer, as described in U.S. Pat. No. 4,076,539.

Silver halide used in the invention functions as light sensor. Silver halide grains are preferably small in size to prevent milky-whitening after image formation and obtain superior images. The grain size is preferably not more than 0.1 $\mu$m, more preferably, 0.01 to 0.1 $\mu$m, and still more preferably, 0.02 to 0.08 $\mu$m. The form of silver halide grains is not specifically limited, including cubic or octahedral, regular crystals and non-regular crystal grains in a spherical, bar-like or tabular form. Halide composition thereof is not specifically limited, including any one of silver chloride, silver chlorobromide, silver iodochlorobromide, silver bromide, silver iodobromide, and silver iodide. Silver halide grains used in the thermally developable photosensitive material are preferably contain iodide, in the vicinity of the grain surface, of 0.1 to 10 mol % on the average, based on the total grains.

The amount of silver halide used in the thermally developable photosensitive material is preferably not more than 50%, more preferably 0.1 to 25%, and still more preferably 0.1 to 15%, based on the total amount of silver halide and organic silver salt.

Photosensitive silver halide used in the thermally developable photosensitive material of the invention can be formed simultaneously with the formation of organic silver salt by allowing a halide component such as a halide ion to concurrently be present together with organic silver salt-forming components and further introducing a silver ion thereinto during the course of preparing the organic silver salt.

Alternatively, a silver halide-forming component is allowed to act onto a pre-formed organic silver salt solution or dispersion or a sheet material containing an organic silver salt to convert a part of the organic silver salt to photosensitive silver halide. The thus formed silver halide is effectively in contact with the organic silver salt, exhibiting favorable actions. In this case, the silver halide-forming component refers to a compound capable of forming silver salt upon reaction with the organic silver salt. Such a compound can be distinguished by the following simple test. Thus, a compound to be tested is to be mixed with the organic silver salt, and if necessary, the presence of a peal specific to silver halide can be confirmed by the X-ray diffractometry, after heating. Compounds that have been confirmed to be effective as a silver halide-forming component include inorganic halide compounds, onium halides, halogenated hydrocarbons, N-halogeno compounds and other halogen containing compounds. These compounds are detailed in U.S. Pat. Nos. 4,009,039, 3,457,075 and 4,003,749, British Patent 1,498,956 and JP-A 53-27027 and 53-25420. Exemplary examples thereof are shown below:

(1) Inorganic halide compound: e.g., a halide compound represented by formula, MXn, in which M represents H, NH4 or a metal atom; n is 1 when M is H or NH4 and a number equivalent to a valence number of the metal atom when M is the metal atom; the metal atom includes lithium, sodium, potassium, cesium, magnesium, calcium, strontium, barium, zinc, cadmium, mercury, tin, antimony, chromium, manganese, cobalt, rhodium, and cerium, and molecular halogen such as aqueous bromine being also effective;

(2) Onium halide: e.g., quaternary ammonium halides such as trimethylphenylammonium bromide, cetylethyldimethylammonium bromide, and trimethylbenzylammonium bromide; and tertiary sulfonium halides such as trimethylsulfonium iodide;

(3) Halogenated hydrocarbons: e.g., iodoform, bromoform, carbon tetrachloride and 2-brom-2-methylpropane;

(4) N-halogeno compounds: e.g., N-chlorosuccinimide, N-bromosucciimde, N-bromophthalimide, N-bromoacetoamide, N-iodosuccinimide, N-bromophthalazinone, N-bromooxazolinone, N-chlorophthalazinone, N-bromoacetoanilide, N,N-dibromobenzenesulfonamide, N-bromo-N-methylbenzenesulfonamide, 1,3-dibromo-4,4-dimethylhydantoin and N-bromourazole;

(5) Other halogen containing compounds: e.g., triphenylmethyl chloride, triphenylmethyl bromide 2-bromoacetic acid, 2-bromoethanol and dichlorobenzophenone.

The silver halide forming component is used stoichiometrically in a small amount per organic silver salt. Thus, it is preferably 0.001 to 0.7 mol, and more preferably 0.03 to 0.5 mol per mol of organic silver salt. The reaction is performed preferably in the presence of polymer as a binder, wherein the polymer to be used is preferably 0.01 to 100 weight parts, and more preferably 0.1 to 10 weight parts per 1 weight part of an organic silver salt.

The thus formed photosensitive silver halide can be chemically sensitized with a sulfur containing compound, gold compound, platinum compound, palladium compound, silver compound, tin compound, chromium compound or their combination. The method and procedure for chemical sensitization are described in U.S. Pat. No. 4,036,650, British Patent 1,518,850, JP-A 51-22430, 51-78319 and 51-81124. As described in U.S. Pat. No. 3,980,482, a low molecular weight amide compound may be concurrently present to enhance sensitivity at the time of converting a part of the organic silver salt to photosensitive silver halide.

To improve reciprocity law failure or adjust contrast, the photosensitive silver halide may be contained with metal ions of the 6th group to 10th group in the periodical table, such as Rh, Ru, Re, Ir, Os, Fe and their complexes and complex ions. Specifically, complex ions are preferred, e.g., Ir complex ions such as $IrCl_6^{2-}$ are preferably contained to improve reciprocity law failure.

Organic silver salts used in the invention are reducible silver source, and silver salts of organic acids or organic heteroacids are preferred and silver salts of long chain fatty acid (preferably having 10 to 30 carbon atom and more preferably 15 to 25 carbon atoms) or nitrogen containing heterocyclic compounds are more preferred. Specifically, organic or inorganic complexes, ligand of which have a total stability constant to a silver ion of 4.0 to 10.0 are preferred. Exemplary preferred complex salts are described in RD17029 and RD29963, including organic acid salts (for example, salts of gallic acid, oxalic acid, behenic acid, stearic acid, palmitic acid, lauric acid, etc.); carboxyalkylthiourea salts (for example, 1-(3-carboxypropyl)thiourea, 1-(3-caroxypropyl)-3,3-dimethylthiourea, etc.); silver complexes of polymer reaction products of aldehyde with hydroxy-substituted aromatic carboxylic acid (for example, aldehydes (formaldehyde, acetaldehyde, butylaldehyde, etc.), hydroxy-substituted acids (for example, salicylic acid, benzoic acid, 3,5-dihydroxybenzoic acid, 5,5-thiodisalicylic acid, silver salts or complexes of thiones (for example, 3-(2-carboxyethyl)-4-hydroxymethyl-4-(thiazoline-2-thione and 3-carboxymethyl-4-thiazoline-2-thione), complexes of silver with nitrogen acid selected from imidazole, pyrazole, urazole, 1,2,4-thiazole, and 1H-tetrazole, 3-amino-5-benzylthio-1,2,4-triazole and benztriazole or salts thereof; silver salts of saccharin, 5-chlorosalicylaldoxime, etc.; and silver salts of mercaptides. Of these organic silver salts, silver salts of fatty acids are preferred, and silver salts of behenic acid, arachidinic acid and stearic acid are specifically preferred.

The organic silver salt compound can be obtained by mixing an aqueous-soluble silver compound with a compound capable of forming a complex. Normal precipitation, reverse precipitation, double jet precipitation and controlled double jet precipitation described in JP-A 9-127643 are preferably employed. For example, to an organic acid is added an alkali metal hydroxide (e.g., sodium hydroxide, potassium hydroxide, etc.) to form an alkali metal salt soap of the organic acid (e.g., sodium behenate, sodium arachidinate, etc.), thereafter, the soap and silver nitrate are mixed by the controlled double jet method to form organic silver salt crystals. In this case, silver halide grains may be concurrently present.

In the present invention, organic silver salts have an average grain diameter of 10 $\mu$m or less and are monodispersed. The average diameter of the organic silver salt as described herein is, when the grain of the organic salt is, for example, a spherical, cylindrical, or tabular grain, a diameter of the sphere having the same volume as each of these grains. The average grain diameter is preferably between 0.05 and 10 $\mu$m, more preferably between 0.05 and 5 $\mu$m and still more preferably between 0.05 and 0.5 $\mu$m. Furthermore, the monodisperse as described herein is the same as silver halide grains and preferred monodispersibility is between 1 and 30%.

It is also preferred that at least 60% of the total of the organic silver salt is accounted for by tabular grains. The tabular grains refer to grains having a ratio of an average grain diameter to grain thickness, i.e., aspect ratio (denoted as AR) of 3 or more:

AR=average diameter ($\mu$m)/thickness ($\mu$m)

To obtain such tabular organic silver salts, organic silver salt crystals are pulverized together with a binder or surfactant, using a ball mill. Thus, using these tabular grains, photosensitive materials exhibiting high density and superior image fastness are obtained.

To prevent hazing of the photosensitive material, the total amount of silver halide and organic silver salt is preferably 0.5 to 2.2 g in equivalent converted to silver per $m^2$, leading to high contrast images.

Commonly known reducing agents are used in thermally developable photosensitive materials, including phenols, polyphenols having two or more phenols, naphthols, bisnaphthols, polyhydoxybenzenes having two or more hydroxy groups, polyhydoxynaphthalenes having two or more hydroxy groups, ascorbic acids, 3-pyrazolidones, pyrazoline-5-ones, pyrazolines, phenylenediamines, hydroxyamines, hydroquinone monoethers, hydrooxamic acids, hydrazides, amidooximes, and N-hydroxyureas. Further, exemplary examples thereof are described in U.S. Pat. Nos. 3,615,533, 3,679,426, 3,672,904, 3,51,252, 3,782, 949, 3,801,321, 3,794,488, 3,893,863, 3,887,376, 3,770,448, 3,819,382, 3,773,512, 3,839,048, 3,887,378, 4,009,039, and 4,021,240; British Patent 1,486,148; Belgian Patent 786, 086; JP-A 50-36143, 50-36110, 50-116023, 50-99719, 50-140113, 51-51933, 51-23721, 52-84727; and JP-B 51-35851.

Of these reducing agents, in cases where fatty acid silver salts are used as an organic silver salt, preferred reducing agents are polyphenols in which two or more phenols are linked through an alkylene group or a sulfur atom, specifically, polyphenols in which two or more phenols are linked through an alkylene group or a sulfur atom and the phenol(s) are substituted at least a position adjacent to a hydroxy group by an alkyl group (e.g., methyl, ethyl, propyl, t-butyl, cyclohexyl) or an acyl group (e.g., acetyl, propionyl). Examples thereof include polyphenols compounds such as 1,1-bis(2-hydroxy-3,5-dimethylphenyl)-3,5,5-trimethylhexane, 1,1-bis(2-hydroxy-3-t-butyl-5-methyphenyl)methane, 1,1-bis(2-hydroxy-3,5-di-t-butylphenyl)methane, 2-hydroxy-3-t-butyl-5-methylphenyl)-(2-hydroxy-5-methylphenyl)methane, 6,6'-benzylidene-bis(2,4-di-t-butylphenol), 6,6'-benzylidene-bis(2-t-butyl-4-methylphenol), 6,6'-benzylidene-bis(2,4-dimethylphenol), 1,1-bis(2-hydroxy-3,5-dimethylphenyl)-2-methylpropane, 1,1,5,5-tetrakis(2-hydroxy-3,5-dimethylphenyl)-2,4-ethylpentane, 2,2-bis(4-hydroxy- 3,5-dimethylphenyl)propane, 2,2-bis(4-hydroxy-3,5-di-t-butylphenyl)propane, as described in U.S. Pat. Nos. 3,589, 903 and 4,021,249, British Patent 1,486,148, JP-A 51-51933, 50-36110 and 52-84727 and JP-B 51-35727; bisnaphthols described in U.S. Pat. No. 3,672,904, such as 2,2'dihydoxy-1,1'-binaphthyl, 6,6'-dibromo-2,2'-dihydroxy-1,1'-binaphthyl, 6,6'-dinitro-2,2'-dihydroxy-1,1'-binaphtyl, bis(2-hydroxy-1-naphthyl)methane, 4,4,-dimethoxy-1,1'-dihydroxy-2,2'-binaphthyl; sulfonamidophenols or sulfonamidonaphthols described in U.S. Pat. No. 3,801,321, such as 4-benzenesulfonamidophenol, 2-benzenesulfonamidophenol, 2,6-dichloro-4-benzenesulfonamidophenol and 4-benzenesulfonamidonaphthol.

The amount of the reducing agent to be used in the thermally developable photosensitive material, depending on the kind of an organic silver salt or reducing agent is preferably 0.05 to 10 mol, and more preferably 0.1 to 3 mol per mol of organic silver salt. Two or more kinds of reducing agents may be used in combination within the amount described above. It is also preferred to add the reducing agent to a photosensitive coating solution immediately before coating, in terms of reduced variation in photographic performance occurred during standing.

The photothermographic material used in the invention contains a hydrazine derivative as a contrast-increasing agent. Preferred hydrazine derivatives are represented by the following formula (H):

Formula (H)

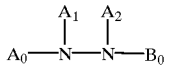

In the formula, $A_0$ is an aliphatic group, aromatic group, heterocyclic group, each of which may be substituted, or —$G_0$—$D_0$ group; $B_0$ is a blocking group; $A_1$ and $A_2$ are both hydrogen atoms, or one of them is a hydrogen atom and the other is an acyl group, a sulfonyl group or an oxalyl group, in which $G_0$ is a —CO—, —COCO—, —CS—, —C(=N$G_1D_1$)—, —SO—, —$SO_2$— or —P(O)($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group.

In Formula (H), an aliphatic group represented by $A_0$ of formula (H) is preferably one having 1 to 30 carbon atoms, more preferably a straight-chained, branched or cyclic alkyl group having 1 to 20 carbon atoms. Examples thereof are methyl, ethyl, t-butyl, octyl, cyclohexyl and benzyl, each of which may be substituted by a substituent (such as an aryl, alkoxy, aryloxy, alkylthio, arylthio, sulfooxy, sulfonamido, sulfamoyl, acylamino or ureido group).

An aromatic group represented by $A_0$ of formula (H) is preferably a monocyclic or condensed-polycyclic aryl group such as a benzene ring or naphthalene ring. A heterocyclic group represented by $A_0$ of formula (H) is preferably a monocyclic or condensed-polycyclic one containing at least one hetero-atom selected from nitrogen, sulfur and oxygen such as a pyrrolidine-ring, imidazole-ring, tetrahydrofuran-ring, morpholine-ring, pyridine-ring, pyrimidine-ring, quinoline-ring, thiazole-ring, benzthiazole-ring, thiophene-ring or furan-ring. In the —$G_0$—$D_0$ group represented by $A_0$, $G_0$ is a —CO—, —COCO—, —CS—, —C(=N$G_1D_1$)—, —SO—, —$SO_2$— or —P(O)($G_1D_1$)— group, in which $G_1$ is a linkage group, or a —O—, —S— or —N($D_1$)— group, in which $D_1$ is a hydrogen atom, or an aliphatic group, aromatic group or heterocyclic group, provided that when a plural number of $D_1$ are present, they may be the same with or different from each other and $D_0$ is an aliphatic group, aromatic group, heterocyclic group, amino group, alkoxy group, aryloxy group, alkylthio group or arylthio group, and preferred $D_0$ is a hydrogen atom, or an alkyl, alkoxyl or amino group. The aromatic group, heterocyclic group or —$G_0$—$D_0$ group represented by $A_0$ each may be substituted.

Specifically preferred $A_0$ is an aryl group or —$G_0$—$D_0$ group.

$A_0$ contains preferably a nondiffusible group or a group for promoting adsorption to silver halide. As the nondiffusible group is preferable a ballast group used in immobile photographic additives such as a coupler. The ballast group includes an alkyl group, alkenyl group, alkynyl group, alkoxy group, phenyl group, pheoxy group and alkylpheoxy group, each of which has 8 or more carbon atoms and is photographically inert.

The group for promoting adsorption to silver halide includes a thioureido group, thiourethane, mercapto group, thioether group, thione group, heterocyclic group, thioamido group, mercapto-heterocyclic group or a adsorption group as described in JP A 64-90439.

In Formula (H), $B_0$ is a blocking group, and preferably —$G_0$—$D_0$, wherein $G_0$ is a —CO—, —COCO—, —CS—, —C(=$NG_1D_1$)—, —SO—, —$SO_2$— or —P(O)($G_1D_1$)— group, and preferred $G_0$ is a —CO—, —COCOA—, in which $G_1$ is a linkage, or a —O—, —S— or —N($D_1$)— group, in which $D_1$ represents a hydrogen atom, or an aliphatic group, aromatic group or heterocyclic group, provided that when a plural number of $D_1$ are present, they may be the same with or different from each other. $D_0$ is an aliphatic group, aromatic group, heterocyclic group, amino group, alkoxy group or mercapto group, and preferably, a hydrogen atom, or an alkyl, alkoxyl or amino group. $A_1$ and $A_2$ are both hydrogen atoms, or one of them is a hydrogen atom and the other is an acyl group, (acetyl, trifluoroacetyl and benzoyl), a sulfonyl group (methanesulfonyl and toluenesulfonyl) or an oxalyl group (ethoxalyl).

A compound represented by formula [H] is exemplified as below, but the present invention is not limited thereto.

H-1

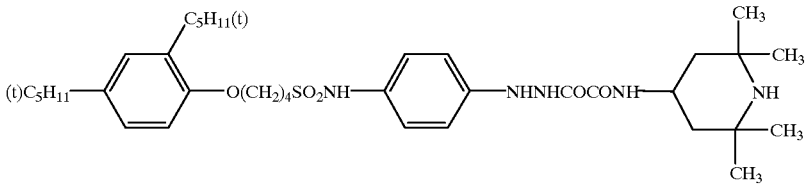

H-2

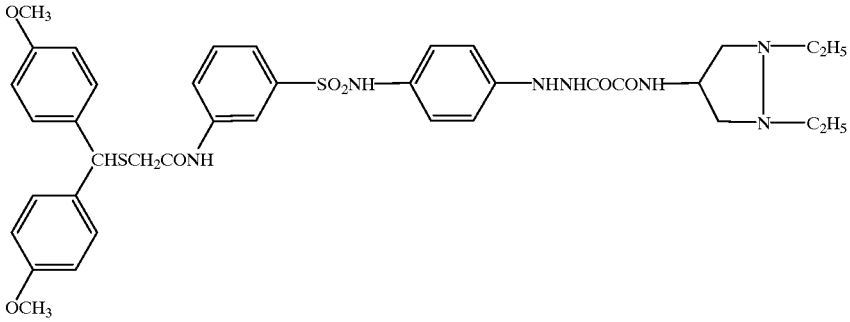

H-3

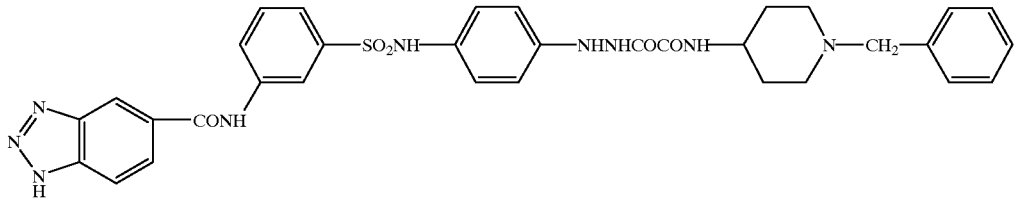

H-4

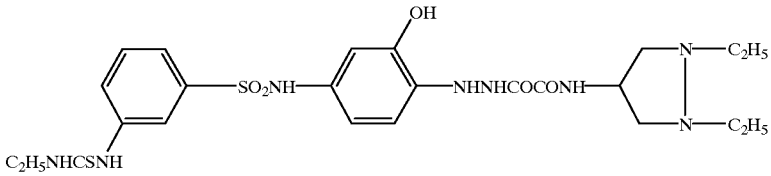

H-5

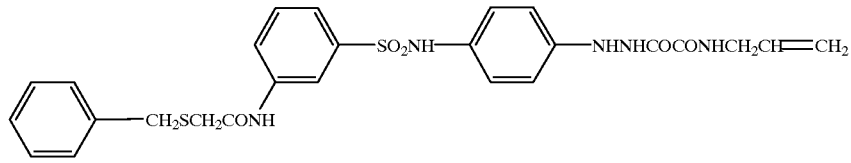

-continued
H-6
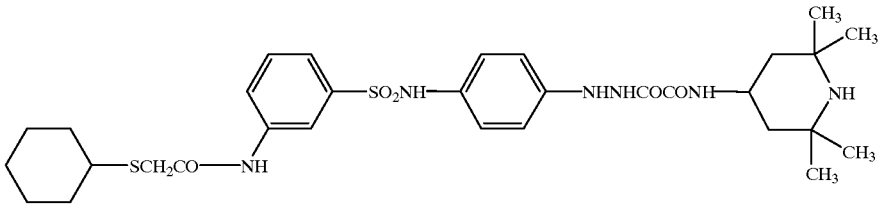
H-7
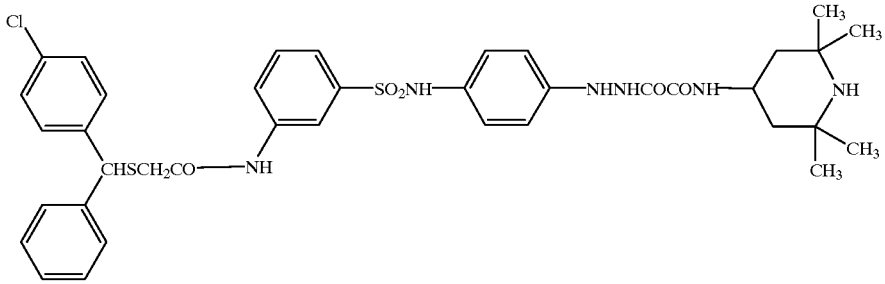
H-8
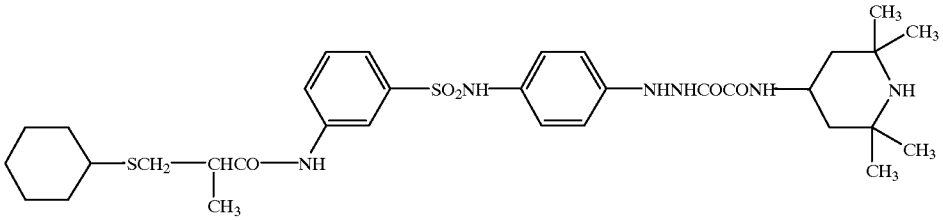
H-9
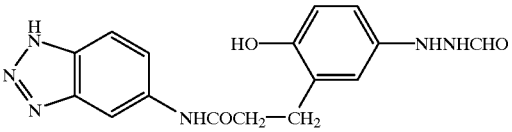
H-10
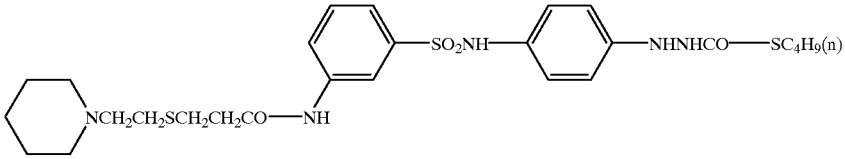
H-11
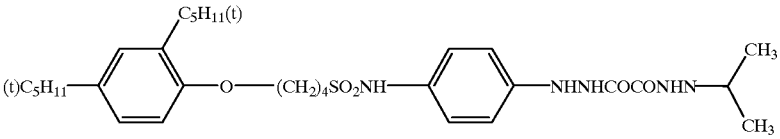
H-12
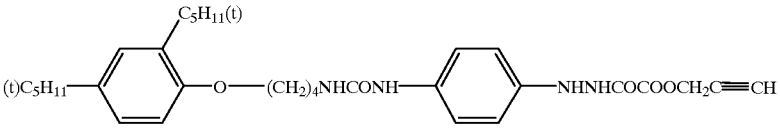
H-13
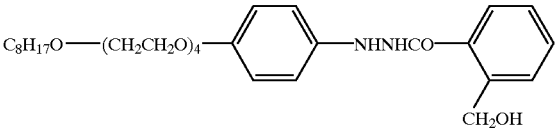
H-14
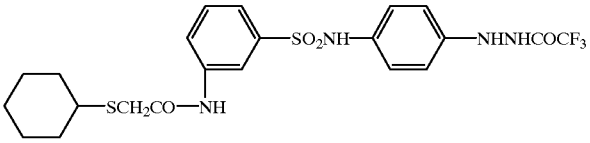

-continued
H-15
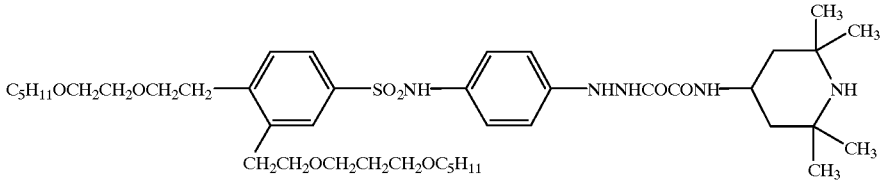
H-16
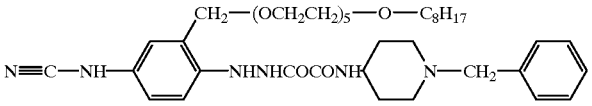
H-17
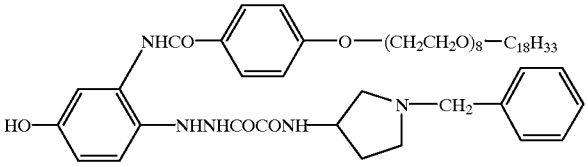
H-18
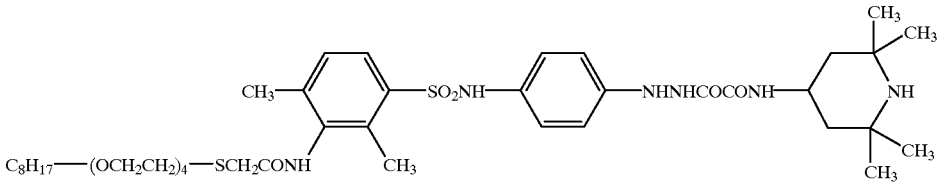
H-19
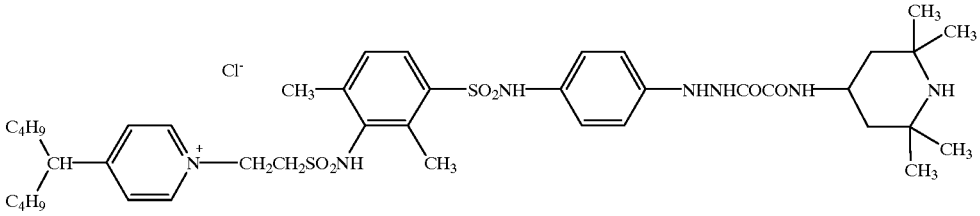
H-20
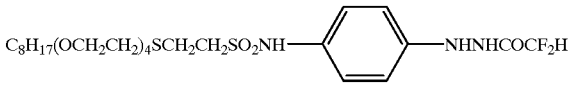
H-21
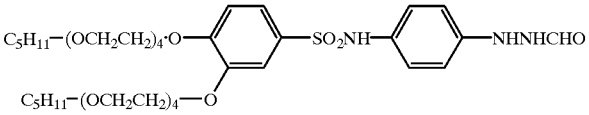
H-22
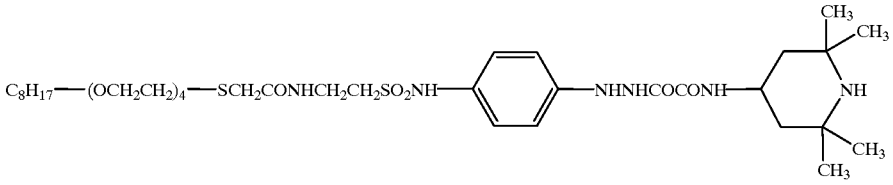
H-23
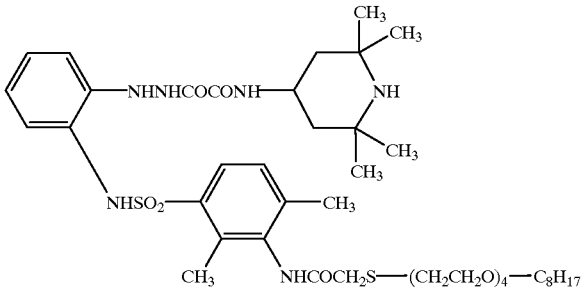

-continued

H-24

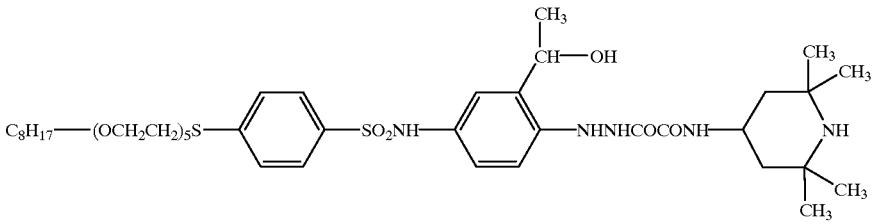

H-25

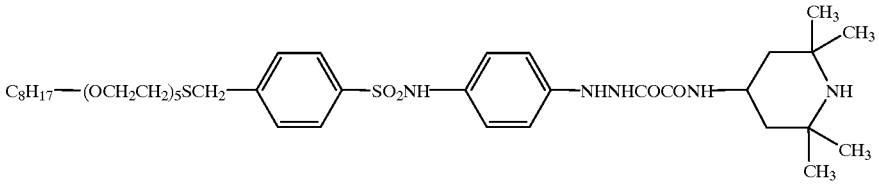

H-26

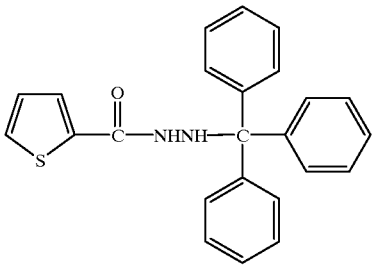

H-27

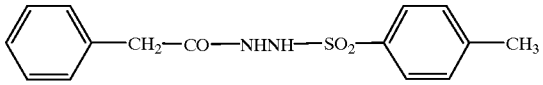

H-28

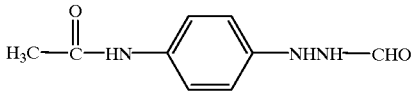

H-29

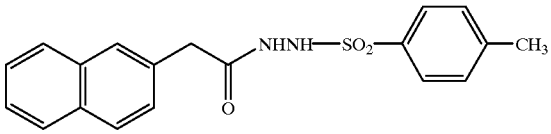

H-30

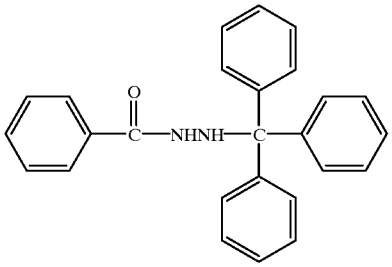

Further, hydrazine derivatives will be described below. More preferred hydrazine derivatives are compounds represented by the following formulas (H-1), (H-2), (H-3), (H-4) and (H-5):

formula (H-1)

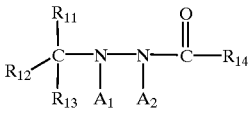

where $R_{11}$, $R_{12}$ and $R_{13}$ are each a substituted or unsubstituted aryl group, or a substituted or unsubstituted heteroaryl group; $R_{14}$ is a heterocyclic-oxy group or a heteroaryl-thio group; $A_1$ and $A_2$ are both hydrogen atoms, or one of them is a hydrogen atom and the other is an acyl group, an alkylsulfonyl group or an oxalyl group;

formula (H-2)

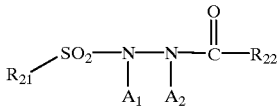

wherein $R_{21}$ is an alkyl group, an aryl group or a heteroaryl group, each of which may be substituted; $R_{22}$ is a hydrogen atom, an alkylamino group, an arylamino group, or a heteroaryl group; $A_1$ and $A_2$ are each the same as defined in formula (H-1);

formula (H-3)

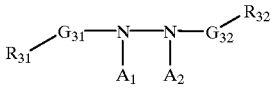

wherein $G_{31}$ and $G_{32}$ are —(CO)p-, —C(=S)—, a sulfonyl group, a sulfooxy group, —P(=O)$R_{33}$— or an iminomethylene group, in which p is 1 or 2 and $R_{33}$ is an alkyl group, an alkenyl group, an aryl group, an alkoxy group, an alkenyloxy group, an alkynyloxy group, an aryloxy group or an amino group, provided that when $G_{31}$ is a sulfonyl group, $G_{32}$ is not a carbonyl group; $R_{31}$ and $R_{32}$ are each a substituent; $A_1$ and $A_2$ are the same as defined in formula (H-1);

formula (H-4)

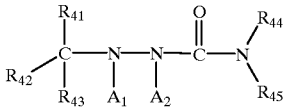

wherein $R_{41}$, $R_{42}$ and $R_{43}$ are each a substituted or unsubstituted aryl group or substituted or unsubstituted heteroaryl group; $R_{44}$ and $R_{45}$ are each a substituted or unsubstituted alkyl group; $A_1$ and $A_2$ are the same as defined in formula (H-1);

formula (H-5)

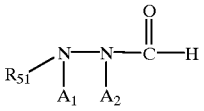

wherein $R_{51}$ is an alkyl group, an alkenyl group, an alkynyl group, an aralkyl group, a heterocyclic group, a substituted amino group, an alkylamino group, an arylamino group, a heterocyclic amino group, a hydrazine group, an alkoxy group, an aryloxy group, a heterocyclic-oxy group, an alkylthio group, an arylthio group, a heterocyclic-thio group, an alkoxycarbonyl group, an aryloxycarbonyl group, heterocyclic-oxycarbonyl group, an alkylthiocarbonyl group, an arylthiocarbonyl group, a heterocyclic-thiocarbonyl group, a carbamoyl group, a carbamoyloxy group, a carbamoylthio group, an oxalyl group, an alkoxyureido group, an aryloxyureido group, or heterocyclic-oxyureido group; $A_1$ and $A_2$ are the same as defined in formula (H-1).

In formula (H-1), examples of the aryl group represented by $R_{11}$, $R_{12}$ or $R_{13}$ include phenyl, p-methylphenyl and naphthyl; and examples of the heteroaryl group include a triazole residue, an imidazole residue, pyridine residue, furan residue and a thiophene residue. $R_{11}$, $R_{12}$ or $R_{13}$ may be bonded through a linkage group. $R_{11}$, $R_{12}$ or $R_{13}$ may be substituted by a substituent. Examples of the substituent include alkyl, alkenyl, alkynyl, aryl, a heterocyclic group, a heterocyclic group containing a quaternary nitrogen atom (e.g., pyridinio), hydroxy, alkoxy (including groups having a ethyleneoxy or propyleneoxy repeating unit), aryloxy, acyloxy, acyl, alkoxycarbonyl, aryloxycarbonyl, carbamoyl, a urethane group, carboxy, imido, amino, carbonamido, sulfonamido, ureido, thioureido, sulfamoylamino, semicarbazido, thiosemicarbazido, hydrazine, a quaternary ammonio group (alkyl-, aryl- or heterocyclic-) thio, a mercapto group, (alkyl- or aryl-) sulfinyl, sulfo, sulfamoyl, (alkyl- or aryl-) sulfonylcarbamoyl, halogen atom, cyano, nitro, and a phosphoric acid-amido group. $R_{11}$, $R_{12}$ and $R_{13}$ preferably are all phenyl groups and more preferably unsubstituted phenyl groups. Examples of heteroaryloxy group represented by $R_{14}$ include pyridyloxy, indolyloxy, benzthizolyloxy, benzimidazolyloxy, furyloxy, thienyloxy, pyrazolyloxy, and imidazolyloxy. Examples of the heteroarylthio group includepyridylthio, indolylthio, benzthiazolylthio, benzimidazolylthio, furylthio, thienylthio, pyrazolylthio, and imidazolylthio. $R_{14}$ is preferably pyridyloxy or thienyloxy. Examples of the acyl group represented by $A_1$ or $A_2$ acetyl, trifluoroacetyl, and benzoyl; examples of the sulfonyl group include methanesulfonyl, and toluenesulfonyl; examples of oxalyl group include ethoxalyl. $A_1$ and $A_2$ are preferably hydrogen atoms.

In formula (H-2), examples of the alkyl group represented by R21 include methyl, ethyl, t-butyl, 2-octyl, cyclohexyl, benzyl, and diphenylmethyl; the aryl or heteroaryl group may be substituted and substituents thereof are the same as defined in $R_{11}$, $R_{12}$ and $R_{13}$. $R_{21}$ is preferably an aryl or heteroaryl group, and more preferably phenyl. Examples of the alkylamino group represented by $R_{22}$ include methylamino, ethylamino, propylamino, butylamino, dimethylamino, diethylamino, and ethylmethylamino; examples of the arylamino group include anilino; examples of the heteroaryl group include thiazolylamino, benzimidazolylamino, and benzthiazolylamino. $R_{22}$ is preferably dimethylamino or diethylamino.

In formula (H-3), univalent substituents represented by $R_{31}$ and $R_{32}$ are the same as defined in formula (H-1), preferably alkyl, aryl, heteroaryl, alkoxy or amino, more preferably aryl or alkoxy, and specifically preferably, $R_{31}$ is phenyl and $R_{32}$ is t-butoxycarbonyl. $G_{31}$ and $G_{32}$ are preferably —CO—, —COCO—, sulfonyl or —CS—, and are more preferably both —CO— groups or sulfonyl groups.

In formula (H-4), $R_{41}$, $R_{42}$ and R43 are the same as defined in $R_{11}$, $R_{12}$ and $R_{13}$. All of them are preferably phenyl groups, and more preferably unsubstituted phenyl groups. Examples of the substituted or unsubstituted alkyl group represented by $R_{44}$ and $R_{45}$ methyl, ethyl, t-butyl, 2-octyl, cyclohexyl, benzyl, and diphenylmethyl; and both of them are preferably ethyl groups. In formula (H-5), $R_{51}$ is the same group as described in $R_{11}$, R31 or $R_{41}$; $A_1$ and $A_2$ are the same as defined in formula (H-1).

Exemplary examples of compounds represented by formulas (H-1) through (H-5) are shown below, but are not limited to these.

H-1-1

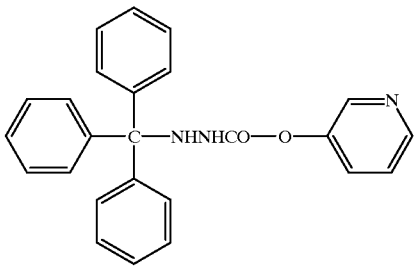

-continued
H-1-2
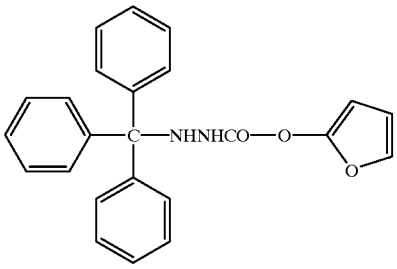
H-1-3
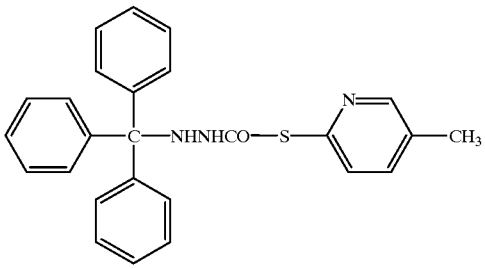
H-1-4
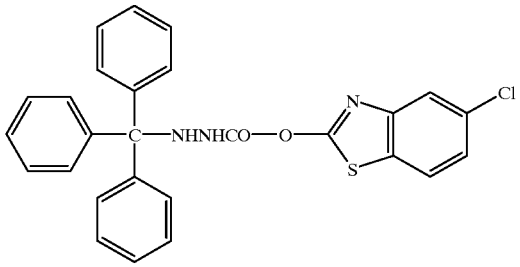
H-1-5
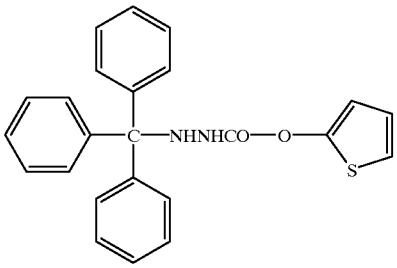
H-1-6
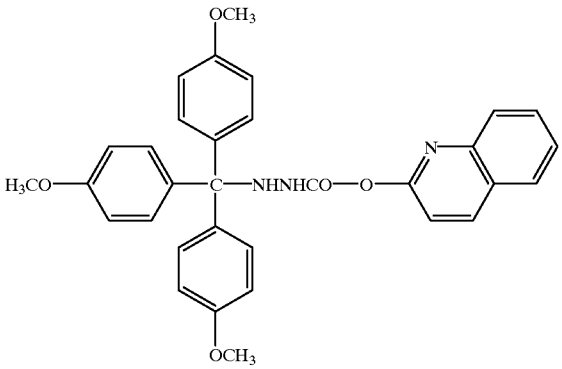
-continued
H-1-7
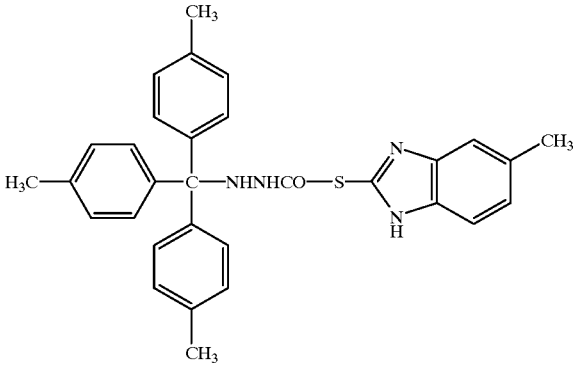
H-1-8
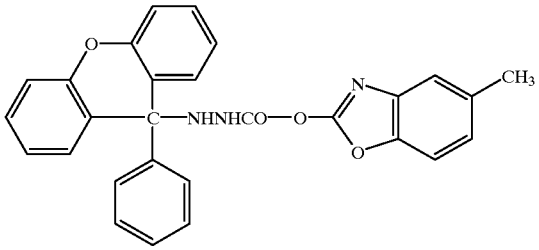
H-1-9
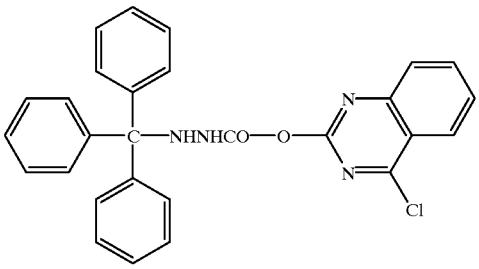
H-1-10
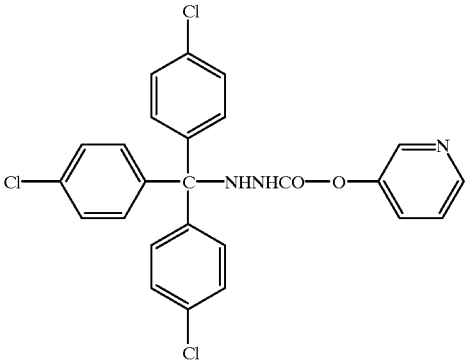
H-1-11
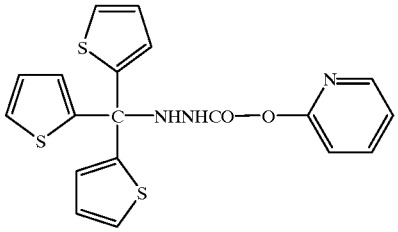

-continued
H-1-12
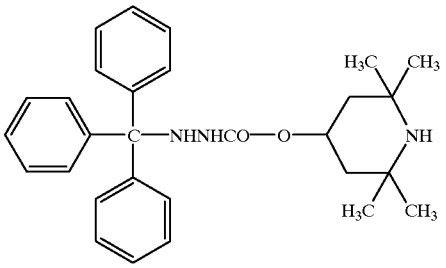
H-2-1
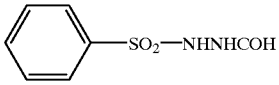
H-2-2
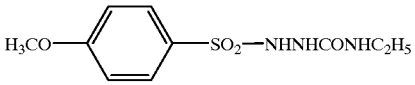
H-2-3
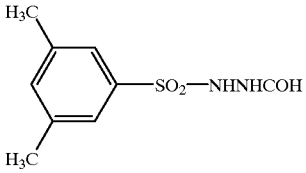
H-2-4
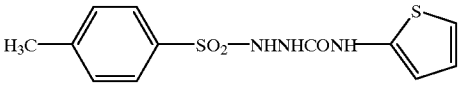
H-2-5
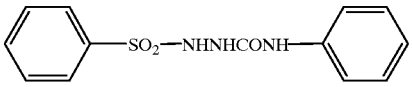
H-2-6
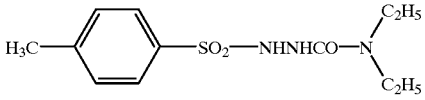
H-2-7
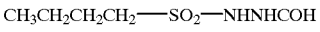
H-2-8
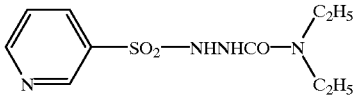
H-2-9
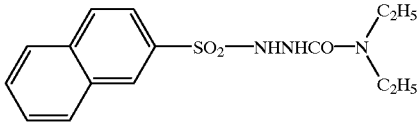
H-3-1
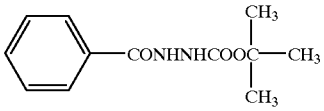
H-3-2
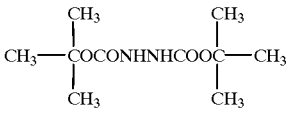
-continued
H-3-3
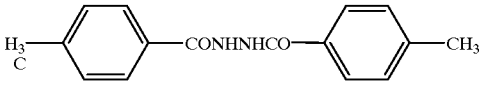
H-3-4
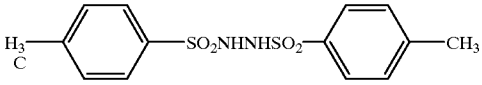
H-3-5
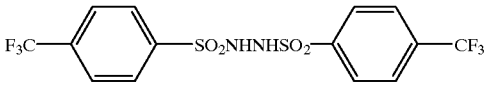
H-3-6
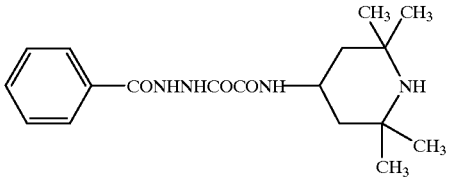
H-3-7
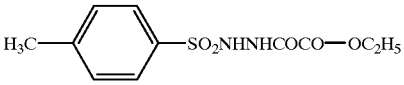
H-3-8
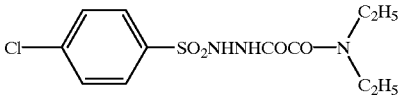
H-3-9
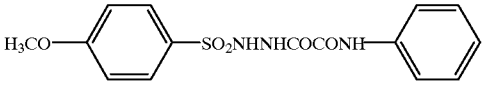
H-3-10
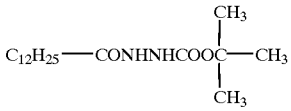
H-3-11
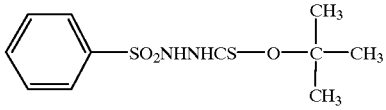
H-3-12
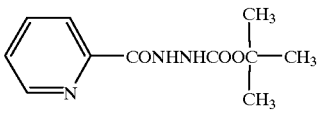

-continued
H-4-1
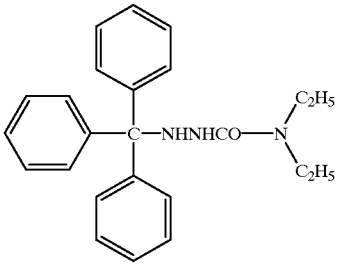
H-4-2
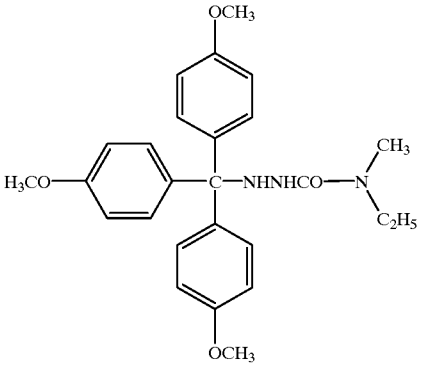
H-4-3
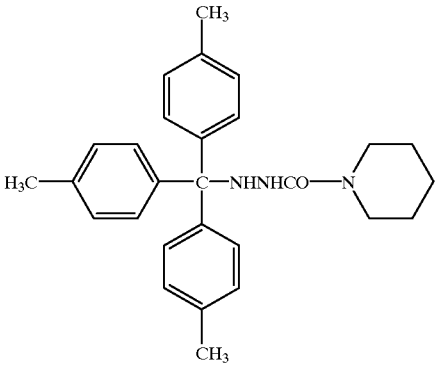
H-4-4
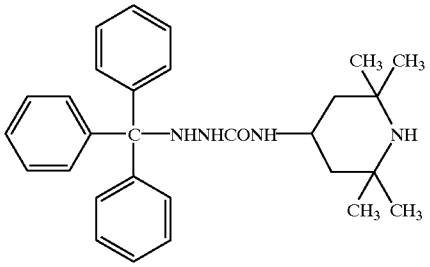
H-4-5
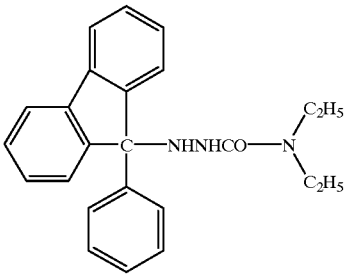
-continued
H-5-1
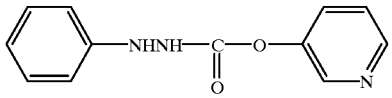
H-5-2
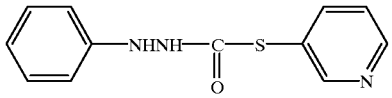
H-5-3
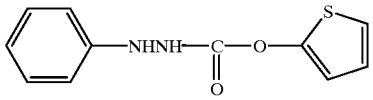
H-5-4
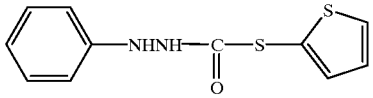
H-5-5
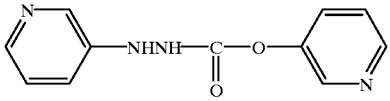
H-5-6
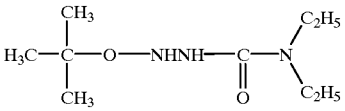
H-5-7
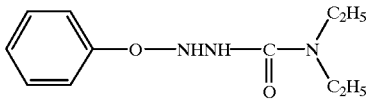
H-5-8
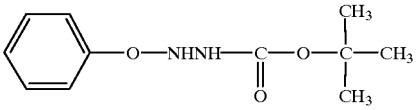
H-5-9
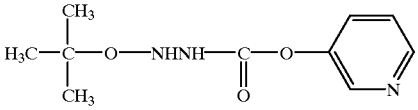
H-5-10
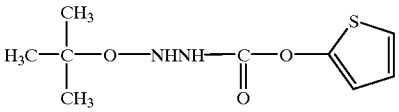
H-5-11
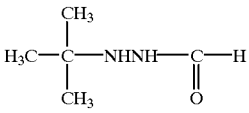
H-5-12
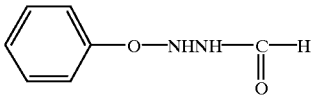
H-5-13
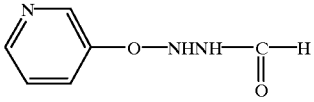

-continued
H-5-14
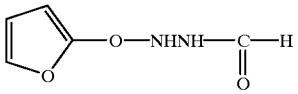
H-5-15
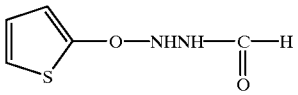
H-5-16
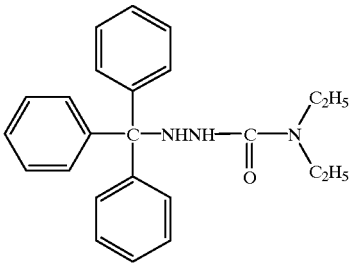
H-5-17
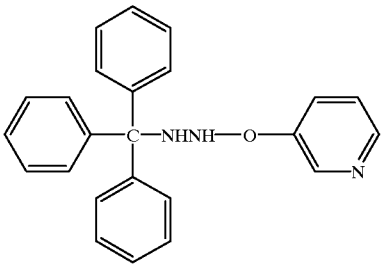
H-5-18
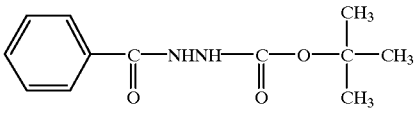
H-5-19
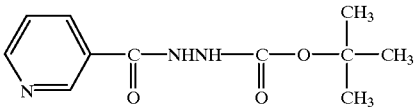
H-5-20
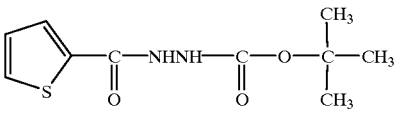
H-5-21
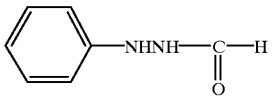
H-5-22
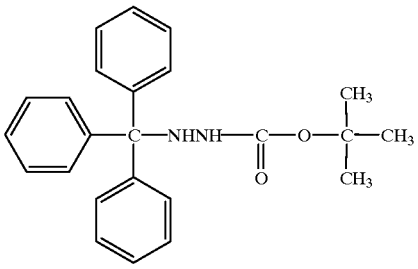
-continued
H-5-23
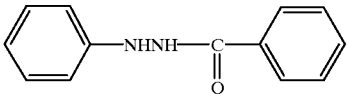
H-5-24
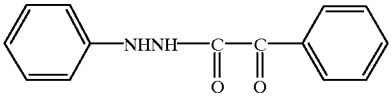
H-5-25
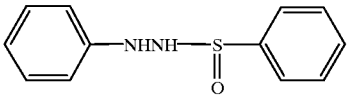
H-5-26
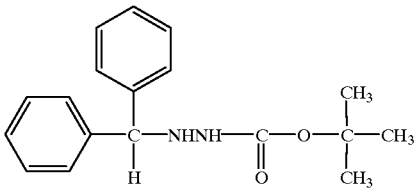
H-5-27
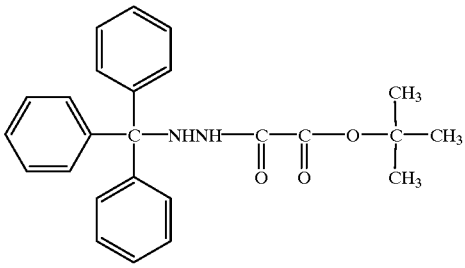
H-5-28
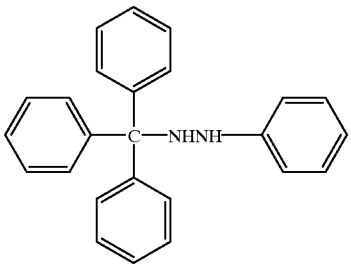
6-1
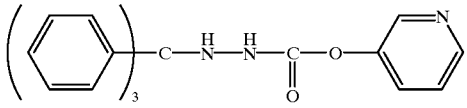
6-2
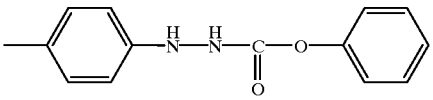

-continued
6-3
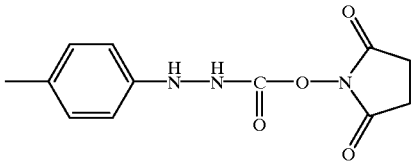
6-4
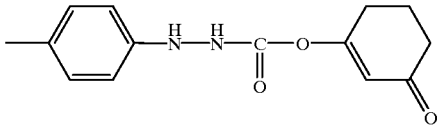
6-5
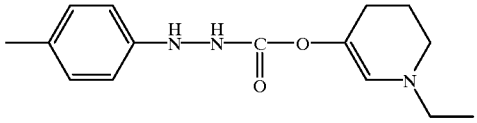
6-6
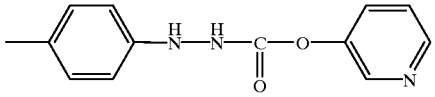
6-7
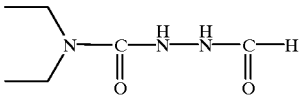
6-8
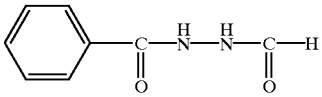
6-9
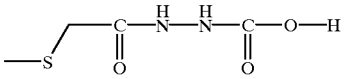
6-10
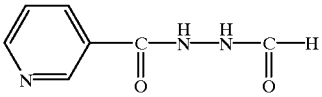
6-11
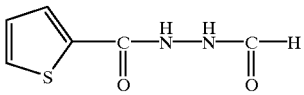
6-12
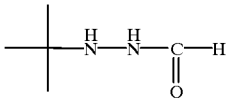
6-13
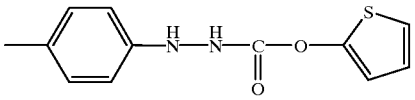
6-14
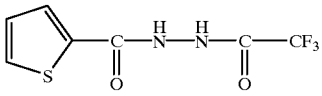
-continued
6-15
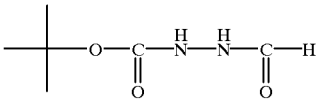
6-16
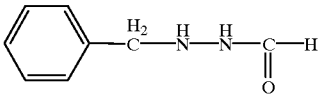
6-17
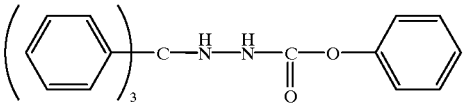
6-18
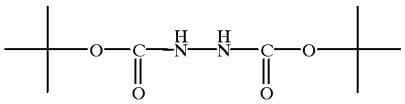
6-19
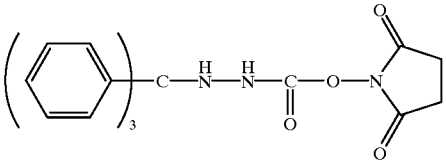
6-20
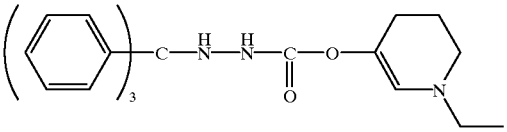
6-21
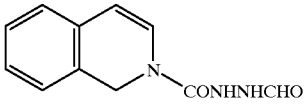
6-22
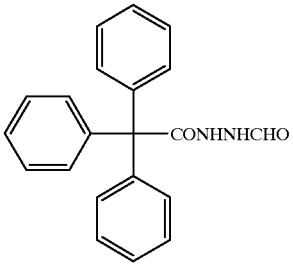
6-23
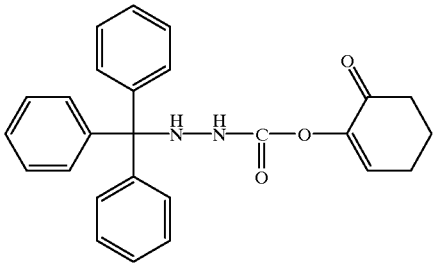

-continued 6-24

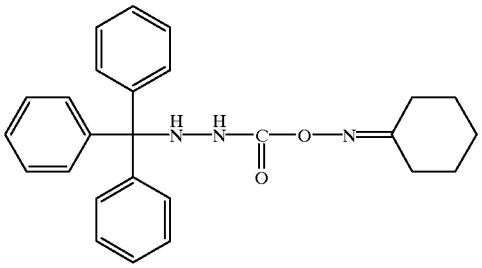

6-25

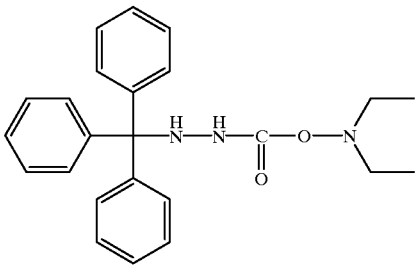

6-26

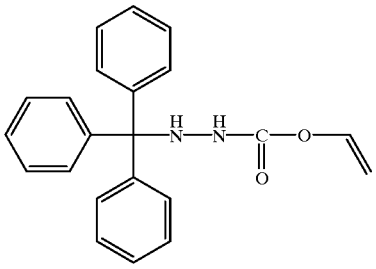

6-27

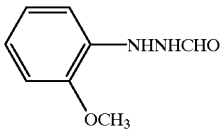

6-28

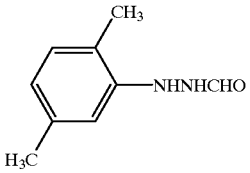

6-29

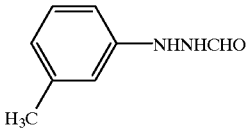

-continued 6-30

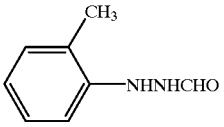

Furthermore, preferred hydrazine derivatives include compounds H-1 through H-29 described in U.S. Pat. No. 5,545,505, col. 11 to col. 20; and compounds 1 to 12 described in U.S. Pat. No. 5,464,738, col. 9 to col. 11.

These hydrazine derivatives can be synthesized in accordance with commonly known methods. The hydrazine derivative is incorporated into a photosensitive layer containing a silver halide emulsion and/or a layer adjacent thereto. The amount to be incorporated, depending of a silver halide grain size, halide composition, a degree of chemical sensitization and the kind of an antifoggant, is preferably $10^{-6}$ to $10^{-1}$, and more preferably $10^{-5}$ to $10^{-2}$ mole per mole of silver halide.

As the nucleating agent may be incorporated compounds represented by formula (G) or compounds represented by formula (P):

formula (G)

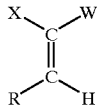

wherein although X and R are represented by a cis-form, X and R may be in a trans-form; and X and W may combine together with each other to form a ring; and formula (P)

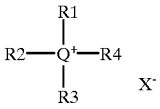

wherein Q is a nitrogen atom or a phosphorus atom; R1, R2, R3 and R4 are each a hydrogen atom or a substituent; X— is an anion, provided that R1, R2, R3 and R4 may combine to form a ring.

Exemplary examples of the compounds represented by formula (G) are shown below.

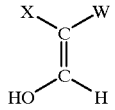
| | W | | | | |
|---|---|---|---|---|---|
| X | —$COCH_3$ | —$COCF_3$ | 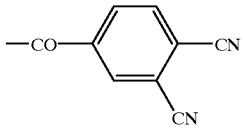 | —CHO | —$COCH_2SCH_3$ |
| —$COOC_2H_5$ | 1-1 | 2-1 | 3-1 | 4-1 | 5-1 |
| —$COCOOC_2H_5$ | 1-2 | 2-2 | 3-2 | 4-2 | 5-2 |
| —$COCF_3$ | 1-3 | 2-3 | 3-3 | 4-3 | 5-3 |
| —$SO_2CH_3$ | 1-4 | 2-4 | 3-4 | 4-4 | 5-4 |
| —CHO | 1-5 | — | 3-5 | 4-5 | 5-5 |
| —$COCH_3$ | 1-6 | — | 3-6 | — | 5-6 |
| —$COCH_2SCH_3$ | — | — | 3-7 | — | 5-7 |
| —$SO_2CF_3$ | 1-7 | 2-5 | 3-8 | 4-6 | 5-8 |
| 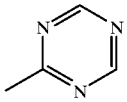 | 1-8 | 2-6 | 3-9 | 4-7 | 5-9 |
| 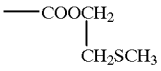 | 1-9 | 2-7 | 3-10 | 4-8 | 5-10 |
| 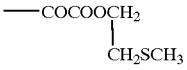 | 1-10 | 2-8 | 3-11 | 4-9 | 5-11 |
| 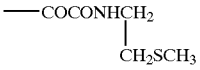 | 1-11 | 2-9 | 3-12 | 4-10 | 5-12 |
40
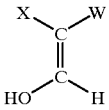
| | W | | |
|---|---|---|---|
| X | —$COCOCH_3$ | —$COCOOC_2H_5$ | —$COCOSC_2H_5$ |
| —$COOC_2H_5$ | 6-1 | 7-1 | 8-1 |
| —$COCOOC_2H_5$ | 6-2 | 7-2 | 8-2 |
| —$COCH_3$ | 6-3 | — | 8-3 |
| —$COCF_3$ | 6-4 | — | 8-4 |
| —$SO_2CH_3$ | 6-5 | 7-3 | 8-5 |
| —$SO_2CF_3$ | 6-6 | 7-4 | 8-6 |
| —CHO | 6-7 | — | 8-7 |
| —$COCH_2SCH_3$ | 6-8 | — | 8-8 |
| 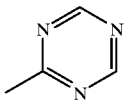 | 6-9 | 7-5 | 8-9 |
| —$COOC_2H_4SCH_3$ | 6-10 | 7-6 | 8-10 |

-continued
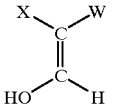
| X | W: —COCOCH$_3$ | W: —COCOOC$_2$H$_5$ | W: —COCOSC$_2$H$_5$ |
|---|---|---|---|
| —COCOOC$_2$H$_4$SCH$_3$ | 6-11 | 7-7 | 8-11 |
| —COCONHC$_2$H$_4$SCH$_3$ | 6-12 | 7-8 | 8-12 |
| 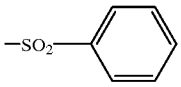 | 6-13 | 7-9 | — |
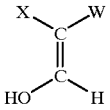
| X | W: —COCONHC$_2$H$_4$SCH$_3$ | W: 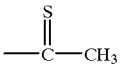 | W: —COOC$_2$H$_5$ | W: —COSC$_2$H$_5$ |
|---|---|---|---|---|
| —COOC$_2$H$_5$ | 9-1 | 10-1 | 11-1 | 12-1 |
| —COCOOC$_2$H$_5$ | 9-2 | 10-2 | — | 12-2 |
| —COCH$_3$ | — | 10-3 | — | 12-3 |
| —COCF$_3$ | — | 10-4 | — | 12-4 |
| —SO$_2$CH$_3$ | 9-3 | 10-5 | 11-2 | 12-5 |
| —SO$_2$CF$_3$ | 9-4 | 10-6 | 11-3 | 12-6 |
| —CHO | — | 10-7 | — | 12-7 |
| —COCH$_2$SCH$_3$ | — | 10-8 | — | 12-8 |
| 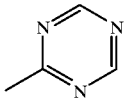 | 9-5 | 10-9 | 11-4 | 12-9 |
| —COOC$_2$H$_4$SCH$_3$ | 9-6 | 10-10 | 11-5 | 12-10 |
| —COCOOC$_2$H$_4$SCH$_3$ | 9-7 | 10-11 | 11-6 | 12-11 |
| —COCONHC$_2$H$_4$SCH$_3$ | 9-8 | 10-12 | — | 12-12 |
| 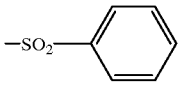 | — | — | 11-7 | — |

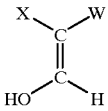
| X | W: —CONH— 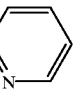 | W: —CSNH—  | W: —$SO_2CH_3$ |
|---|---|---|---|
| —$COOC_2H_5$ | 13-1 | 14-1 | 15-1 |
| —$COCOOC_2H_5$ | 13-2 | 14-2 | 15-2 |
| —$COCH_3$ | 13-3 | 14-3 | — |
| —$COCF_3$ | 13-4 | 14-4 | — |
| —$SO_2CH_3$ | 13-5 | 14-5 | 15-3 |
| —$SO_2CF_3$ | 13-6 | 14-6 | 15-4 |
| —CHO | 13-7 | 14-7 | — |
| —$COCH_2SCH_3$ | 13-8 | 14-8 | — |
| 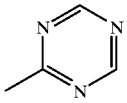 | 13-9 | 14-9 | 15-5 |
| —COO$CH_2$ \| $CH_2SCH_3$ | 13-10 | 14-10 | 15-6 |
| —COCOO$CH_2$ \| $CH_2SCH_3$ | 13-11 | 14-11 | 15-7 |
| —COCONH$CH_2$ \| $CH_2SCH_3$ | 13-12 | 14-12 | 15-8 |
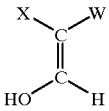
| X | W: —$SO_2CF_3$ | W: —$SOCH_3$ | W: —$SO_2OCH_3$ | W: —$SO_2SCH_3$ | W: —$SO_2NH_2$ |
|---|---|---|---|---|---|
| —$COOC_2H_5$ | — | 17-1 | 18-1 | 19-1 | 20-1 |
| —$COCOOC_2H_5$ | — | 17-2 | 18-2 | 19-2 | 20-2 |
| —$COCH_3$ | — | 17-3 | 18-3 | 19-3 | 20-3 |
| —$COCF_3$ | — | 17-4 | 18-4 | 19-4 | 20-4 |
| —$SO_2CH_3$ | — | 17-5 | 18-5 | 19-5 | 20-5 |
| —$SO_2CF_3$ | — | 17-6 | 18-6 | 19-6 | 20-6 |
| —CHO | — | 17-7 | 18-7 | 19-7 | 20-7 |
| —$COCH_2SCH_3$ | — | 17-8 | 18-8 | 19-8 | 20-8 |
| 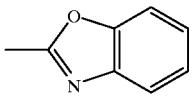 | 16-1 | 17-9 | 18-9 | 19-9 | 20-9 |

-continued
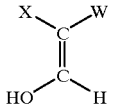
| X | W: —$SO_2CF_3$ | —$SOCH_3$ | —$SO_2OCH_3$ | —$SO_2SCH_3$ | —$SO_2NH_2$ |
|---|---|---|---|---|---|
| —$COOCH_2$ \| $CH_2SCH_3$ | — | 17-10 | 18-10 | 19-10 | 20-10 |
| —$COCOOCH_2$ \| $CH_2SCH_3$ | — | 17-11 | 18-11 | 19-11 | 20-11 |
| —$COCONHCH_2$ \| $CH_2SCH_3$ | 16-2 | 17-12 | 18-12 | 19-12 | 20-12 |
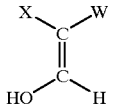
| X | W: —$SO(=O)CH_3$ | —$SO(=O)SC_2H_5$ | —$SO(=O)NHCH_3$ | —$P(=O)(OC_2H_5)OC_2H_5$ | —$NO_2$ |
|---|---|---|---|---|---|
| —$COOCF_2$ \| $CF_2H$ | 12-1 | 22-1 | 23-1 | 24-1 | 25-1 |
| —$COCOOCH_2CF_2$ \| $CF_2H$ | 21-2 | 22-2 | 23-2 | 24-2 | 25-2 |
| —$COCH_3$ | 21-3 | 22-3 | 23-3 | 24-3 | 25-3 |
| —$COCF_3$ | 21-4 | 22-4 | 23-4 | 24-4 | 25-4 |
| —$SO_2CH_3$ | 21-5 | 22-5 | 23-5 | 24-5 | 25-5 |
| —$SO_2CF_3$ | 21-6 | 22-6 | 23-6 | 24-6 | 25-6 |
| —CHO | 21-7 | 22-7 | 23-7 | 24-7 | 25-7 |
| —$COCH_2SCH_3$ | 21-8 | 22-8 | 23-8 | 24-8 | 25-8 |
| 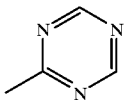 | 21-9 | 22-9 | 23-9 | 24-9 | 25-9 |
| —$COOCH_2$ \| $CH_2SCH_3$ | 21-10 | 22-10 | 23-10 | 24-10 | 25-10 |
| —$COCOOCH_2$ \| $CH_2SCH_3$ | 21-11 | 22-11 | 23-11 | 24-11 | 25-11 |

-continued
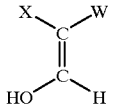
| X | W | | | | |
|---|---|---|---|---|---|
| | $-\overset{O}{\overset{\Vert}{S}}OCH_3$ | $-\overset{O}{\overset{\Vert}{S}}SC_2H_5$ | $-\overset{O}{\overset{\Vert}{S}}NHCH_3$ | $-\overset{O}{\overset{\Vert}{P}}(OC_2H_5)_2$ | $-NO_2$ |
| $-COCONHCH_2CH_2SCH_3$ | 21-12 | 22-12 | 23-12 | 24-12 | 25-12 |
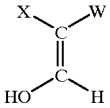
| X | W | | | | |
|---|---|---|---|---|---|
| | 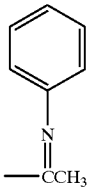 | 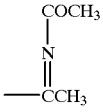 | 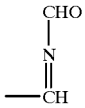 | 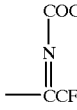 | 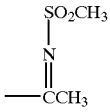 |
| $-COOC_2H_5$ | 26-1 | 27-1 | 28-1 | 29-1 | 30-1 |
| $-COCOOC_2H_5$ | 26-2 | 27-2 | 28-2 | 29-2 | 30-2 |
| $-COCH_3$ | 26-3 | 27-3 | 28-3 | 29-3 | 30-3 |
| $-COCF_3$ | 26-4 | 27-4 | 28-4 | 29-4 | 30-4 |
| $-SO_2CH_3$ | 26-5 | 27-5 | 28-5 | 29-5 | 30-5 |
| $-SO_2CF_3$ | 26-6 | 27-6 | 28-6 | 29-6 | 30-6 |
| $-CHO$ | 26-7 | 27-7 | 28-7 | 29-7 | 30-7 |
| 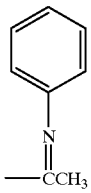 | 26-8 | 27-8 | 28-8 | 29-8 | 30-8 |
| 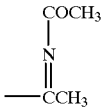 | — | 27-9 | 28-9 | 29-9 | 30-9 |
| 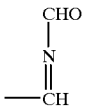 | — | — | 28-10 | 29-10 | 30-10 |

-continued
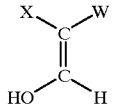
| X | W | | | | |
|---|---|---|---|---|---|
| | 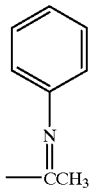 | 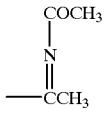 | 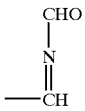 | 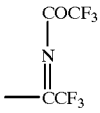 | 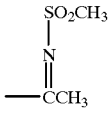 |
| 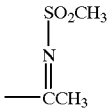 | — | — | — | 29-11 | 30-11 |
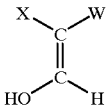
| X | W | | | | |
|---|---|---|---|---|---|
| | 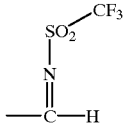 | 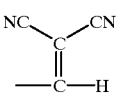 | 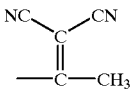 | 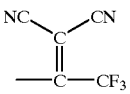 | 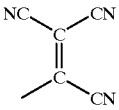 |
| —$COOC_2H_5$ | 31-1 | 32-1 | 33-1 | 34-1 | 35-1 |
| —$COCOOC_2H_5$ | 31-2 | 32-2 | 33-2 | 34-2 | 35-2 |
| —$COCH_3$ | 31-3 | 32-3 | 33-3 | 34-3 | 35-3 |
| —$COCF_3$ | 31-4 | 32-4 | 33-4 | 34-4 | 35-4 |
| —CHO | 31-5 | 32-5 | 33-5 | 34-5 | 35-5 |
| —$SO_2CH_3$ | 31-6 | 32-6 | 33-6 | 34-6 | 35-6 |
| —$SO_2CF_3$ | 31-7 | 32-7 | 33-7 | 34-7 | 35-7 |
| 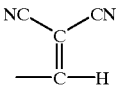 | 31-8 | 32-8 | 33-8 | 34-8 | 35-8 |
| 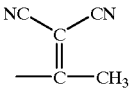 | 31-9 | — | 33-9 | 34-9 | 35-9 |
| 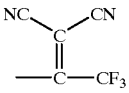 | 31-10 | — | — | 34-10 | 35-10 |
| 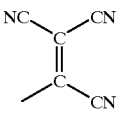 | 31-11 | — | — | — | 35-11 |

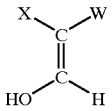
| X | W: —$CF_3$ | —CH═CHCN | —CH═CHCHO | —C≡$CCF_3$ | —C≡CCN |
|---|---|---|---|---|---|
| —$COOC_2H_5$ | 36-1 | 37-1 | 38-1 | 39-1 | 40-1 |
| —$COCOOC_2H_5$ | 36-2 | 37-2 | 38-2 | 39-2 | 40-2 |
| —$COCF_3$ | 36-3 | 37-3 | 38-3 | 39-3 | 40-3 |
| —$SO_2CH_3$ | 36-4 | 37-4 | 38-4 | 39-4 | 40-4 |
| —$COCH_3$ | 36-5 | 37-5 | 38-5 | 39-5 | 40-5 |
| —$SO_2CF_3$ | 36-6 | 37-6 | 38-6 | 39-6 | 40-6 |
| —CHO | 36-7 | 37-7 | 38-7 | 39-7 | 40-7 |
| —$COCH_2SCH_3$ | 36-8 | 37-8 | 38-8 | 39-8 | 40-8 |
| 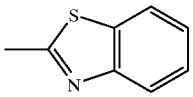 | 36-9 | 37-9 | 38-9 | 39-9 | 40-9 |
| —$COOCH_2$ \| $CH_2SCH_3$ | 36-10 | 37-10 | 38-10 | 39-10 | 40-10 |
| —$COCOOCH_2$ \| $CH_2SCH_3$ | 36-11 | 37-11 | 38-11 | 39-11 | 40-11 |
| —$COCONHCH_2$ \| $CH_2SCH_3$ | 36-12 | 37-12 | 38-12 | 39-12 | 40-12 |
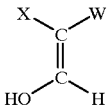
| X | W: 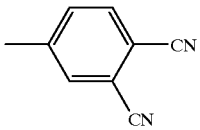 | 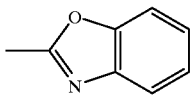 | 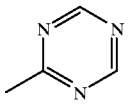 | Cl | H |
|---|---|---|---|---|---|
| —$COOC_2H_5$ | 41-1 | 42-1 | 43-1 | 44-1 | 45-1 |
| —$COCOOC_2H_5$ | 41-2 | 42-2 | 43-2 | 44-2 | 45-2 |
| —$COCH_3$ | 41-3 | 42-3 | — | 44-3 | 45-3 |
| —$COCF_3$ | 41-4 | 42-4 | — | 44-4 | 45-4 |
| —$SO_2CH_3$ | 41-5 | 42-5 | 43-3 | 44-5 | 45-5 |
| —$SO_2CF_3$ | 41-6 | — | 43-4 | 44-6 | 45-6 |
| —CHO | 41-7 | 42-6 | — | 44-7 | 45-7 |
| —$COCH_2SCH_3$ | 41-8 | 42-7 | — | 44-8 | 45-8 |
| 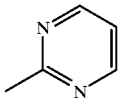 | 41-9 | 42-8 | 43-5 | 44-9 | 45-9 |

-continued
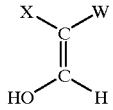
| X | W | | | | |
|---|---|---|---|---|---|
| | 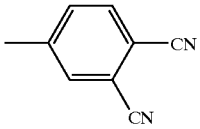 | 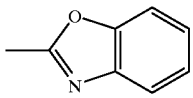 | 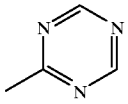 | Cl | H |
| —COOCH$_2$ \| CH$_2$SCH$_3$ | 41-10 | 42-9 | 43-6 | 44-10 | 45-10 |
| —COCOOCH$_2$ \| CH$_2$SCH$_3$ | 41-11 | 42-10 | 43-7 | 44-11 | 45-11 |
| —COCONHCH$_2$ \| CH$_2$SCH$_3$ | 41-12 | 42-11 | 43-8 | 44-12 | 45-12 |
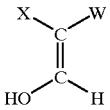
| X | W | | | | |
|---|---|---|---|---|---|
| | 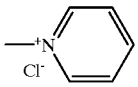 | 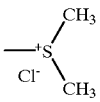 | 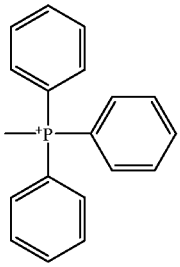 | 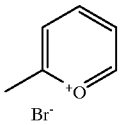 | 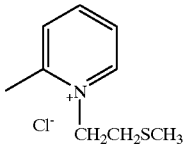 |
| —COOC$_2$H$_5$ | 46-1 | 47-1 | 48-1 | 49-1 | 50-1 |
| —COCOOC$_2$H$_5$ | 46-2 | 47-2 | 48-2 | 49-2 | 50-2 |
| —COCH$_3$ | 46-3 | 47-3 | 48-3 | 49-3 | 50-3 |
| —COCF$_3$ | 46-4 | 47-4 | 48-4 | 49-4 | 50-4 |
| —SO$_2$CH$_3$ | 46-5 | 47-5 | 48-5 | 49-5 | 50-5 |
| —SO$_2$CF$_3$ | 46-6 | 47-6 | 48-6 | 49-6 | 50-6 |
| —CHO | 46-7 | 47-7 | 48-7 | 49-7 | 50-7 |
| —COCH$_2$SCH$_3$ | 46-8 | 47-8 | 48-8 | 49-8 | 50-8 |
| 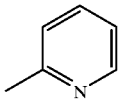 | 46-9 | 47-9 | 48-9 | 49-9 | 50-9 |
| —COOCH$_2$ \| CH$_2$SCH$_3$ | 46-10 | 47-10 | 48-10 | 49-10 | 50-10 |

-continued
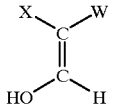
| X | W | | | | |
|---|---|---|---|---|---|
| | 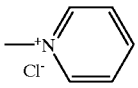 | 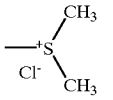 | 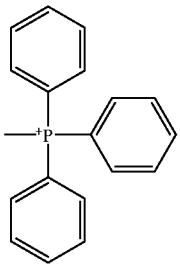 | 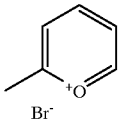 | 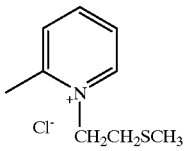 |
| 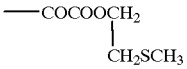 | 46-11 | 47-11 | 48-11 | 49-11 | 50-11 |
| 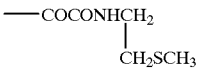 | 46-12 | 47-12 | 48-12 | 49-12 | 50-12 |
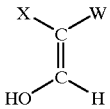
| X | W | |
|---|---|---|
| | 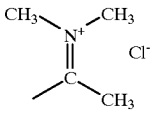 | 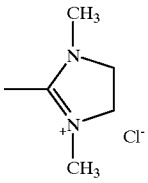 |
| $—COOC_2H_5$ | 51-1 | 52-1 |
| $—COCOOC_2H_5$ | 51-2 | 52-2 |
| $—COCH_3$ | 51-3 | 52-3 |
| $—COCCl_3$ | 51-4 | 52-4 |
| $—SO_2CH_3$ | 51-5 | 52-5 |
| $—SO_2CF_3$ | 51-6 | 52-6 |
| —CHO | 51-7 | 52-7 |
| 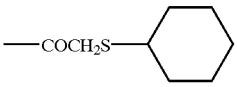 | 51-8 | 52-8 |
| 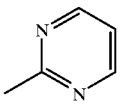 | 51-9 | 52-9 |

-continued
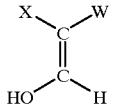
| X | W | |
|---|---|---|
| | 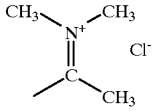 | 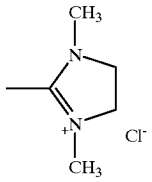 |
| —COOCH(CH2SC2H5) | 51-10 | 52-10 |
| —COCOOCH(CH2SC2H5) | 51-11 | 52-11 |
| —COCONHCH(CH2S—C6H11) | 51-12 | 52-12 |
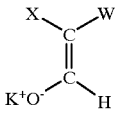
| X | W | | | | |
|---|---|---|---|---|---|
| | —$COCH_3$ | —$COCF_3$ | —CHO | —$COCH_2SCH_3$ | —$SO_2CH_3$ |
| —$COOC_2H_5$ | 53-1 | 54-1 | 55-1 | 56-1 | 57-1 |
| —$COCOOC_2H_5$ | 53-2 | 54-2 | 55-2 | 56-2 | 57-2 |
| —$COCH_3$ | 53-3 | 54-3 | 55-3 | 56-3 | 57-3 |
| —$COCF_3$ | — | 54-4 | 55-4 | 56-4 | 57-4 |
| —CHO | — | — | 55-5 | 56-5 | 57-5 |
| —$SO_2CH_3$ | — | — | — | 56-6 | 57-6 |
| —$SO_2CF_3$ | 53-4 | 54-5 | 55-6 | 56-7 | 57-7 |
| —$COCH_2SCH_3$ | — | — | — | 56-8 | — |
| 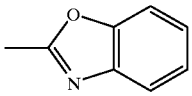 | 53-5 | 54-6 | 55-7 | 56-9 | 57-8 |
| —COOCH(CH2SCH3) | 53-6 | 54-7 | 55-8 | 56-10 | 57-9 |
| —COCOOCH(CH2SCH3) | 53-7 | 54-8 | 55-9 | 56-11 | 57-10 |

-continued
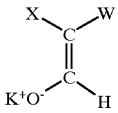
| X | W: —$COCH_3$ | —$COCF_3$ | —CHO | —$COCH_2SCH_3$ | —$SO_2CH_3$ |
|---|---|---|---|---|---|
| —COCONH$CH_2$ \| $CH_2SCH_3$ | 53-8 | 54-9 | 55-10 | 56-12 | 57-11 |
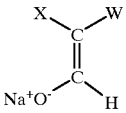
| X | W: —$SO_2CF_3$ | 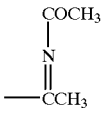 | 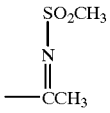 | 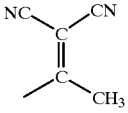 | 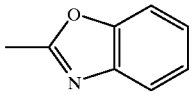 |
|---|---|---|---|---|---|
| —$COOC_2H_5$ | 58-1 | 59-1 | 60-1 | 61-1 | 62-1 |
| —$COCOOC_2H_5$ | 58-2 | 59-2 | 60-2 | 61-2 | 62-2 |
| —$COCH_3$ | — | 59-3 | 60-3 | 61-3 | — |
| —$COCF_3$ | — | 59-4 | 60-4 | 61-4 | — |
| —CHO | — | 59-5 | 60-5 | 61-5 | — |
| —$SO_2CH_3$ | — | 59-6 | 60-6 | 61-6 | — |
| —$SO_2CF_3$ | 58-3 | 59-7 | 60-7 | 61-7 | 62-3 |
| —$COCH_2SCH_3$ | 58-4 | 59-8 | 60-8 | 61-8 | — |
| 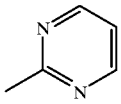 | 58-5 | 59-9 | 60-9 | 61-9 | 62-4 |
| —COO$CH_2$ \| $CH_2SCH_3$ | 58-6 | 59-10 | 60-10 | 61-10 | 62-5 |
| —COCOO$CH_2$ \| $CH_2SCH_3$ | 58-7 | 59-11 | 60-11 | 61-11 | 62-6 |
| —COCONH$CH_2$ \| $CH_2SCH_3$ | 58-8 | 59-12 | 60-12 | 61-12 | 62-7 |

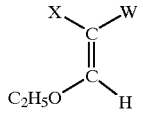
| X | W: —COCCl$_3$ | W: —COCF$_2$—CF$_2$H | W: —CHO | W: —COCH$_2$SCH$_3$ |
|---|---|---|---|---|
| —COOCH$_2$—CH$_2$SCH$_3$ | 63-1 | 64-1 | 65-1 | 66-1 |
| —COCOOCH$_2$—CH$_2$SCH$_3$ | 63-2 | 64-2 | 65-2 | 66-2 |
| —COCF$_3$ | 63-3 | 64-3 | 65-3 | 66-3 |
| —CHO | 63-4 | 64-4 | 65-4 | 66-4 |
| —SO$_2$CH$_3$ | 63-5 | 64-5 | 65-5 | 66-5 |
| —SO$_2$CF$_3$ | 63-6 | 64-6 | 65-6 | 66-6 |
| —COCH$_2$SCH$_3$ | 63-7 | 64-7 | 65-7 | 66-7 |
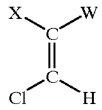
| X | W: —COCF$_3$ | W: —CHO | W: —COCH$_2$SCH$_3$ | W: 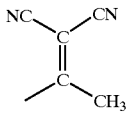 | W: 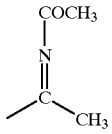 | W: 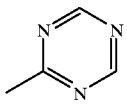 |
|---|---|---|---|---|---|---|
| —COOC$_2$H$_5$ | 67-1 | 67-2 | — | 67-4 | 67-6 | — |
| —COCH$_2$SCH$_3$ | — | — | 67-3 | — | — | — |
| —COCH$_3$ | — | — | — | — | — | 67-5 |
68-1
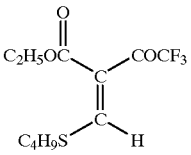
68-2
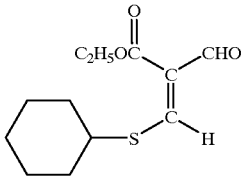
-continued
68-3
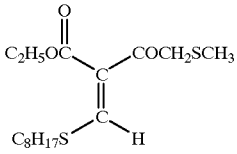
68-4
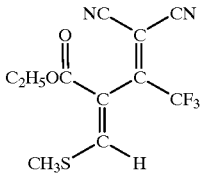

-continued
68-5
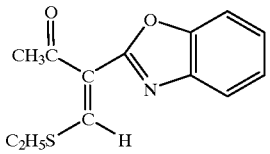
68-6
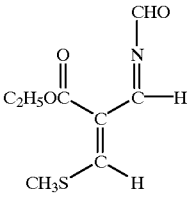
69-1
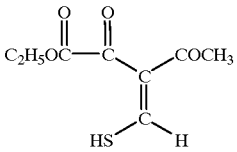
69-2
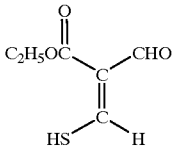
70-1
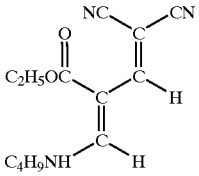
71-1
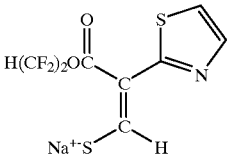
71-2
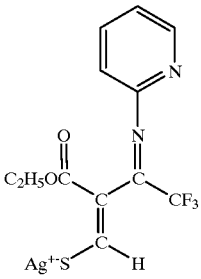
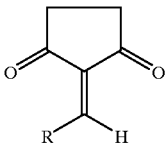
R:
72-1 —OH
72-4 —$OC_2H_5$
72-7 —$SCH_3$
-continued
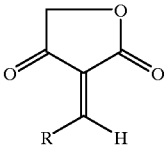
R:
72-2 —OH
72-3 —$O^-Na^+$
72-5 —$OCH_3$
72-6 —$O^-Ag^+$
72-8 —$SC_4H_9$
72-9 —$S^-K^+$
72-10
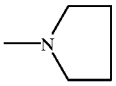
72-11 —Cl
72-12
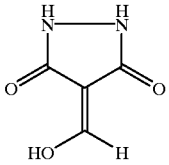
72-13
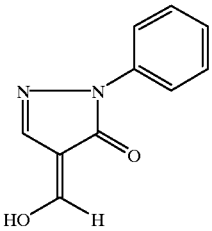
72-14
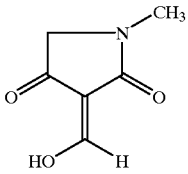
72-15
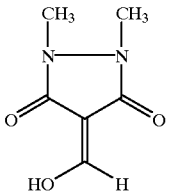

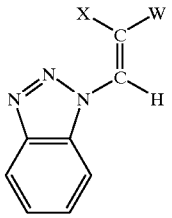
| X | W: —$COCH_3$ | —$COCF_3$ | —CHO | —$COCH_2SCH_3$ | —$SO_2CH_3$ |
|---|---|---|---|---|---|
| —$COOC_2H_5$ | 73-1 | 74-1 | 75-1 | 76-1 | 77-1 |
| —$COCOOC_2H_5$ | 73-2 | 74-2 | 75-2 | 76-2 | 77-2 |
| —$COCH_3$ | 73-3 | 74-3 | 75-3 | 76-3 | 77-3 |
| —$COCF_3$ | — | 74-4 | 75-4 | 76-4 | 77-4 |
| —CHO | — | — | 75-5 | 76-5 | 77-5 |
| —$SO_2CH_3$ | — | — | — | 76-6 | 77-6 |
| —$SO_2CF_3$ | 73-4 | 74-5 | 75-6 | 76-7 | 77-7 |
| —$COCH_2SCH_3$ | — | — | — | 76-8 | — |
| 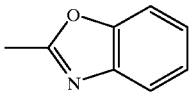 | 73-5 | 74-6 | 75-7 | 76-9 | 77-8 |
| —$COOCH_2$ \| $CH_2SCH_3$ | 73-6 | 74-7 | 75-8 | 76-10 | 77-9 |
| —$COCOOCH_2$ \| $CH_2SCH_3$ | 73-7 | 74-8 | 75-9 | 76-11 | 77-10 |
| —$COCONHCH_2$ \| $CH_2SCH_3$ | 73-8 | 74-9 | 75-10 | 76-12 | 77-11 |
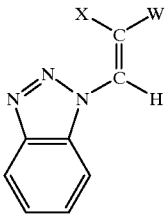
| X | W: —$SO_2CF_3$ | 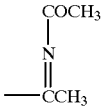 | 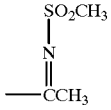 | 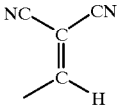 | 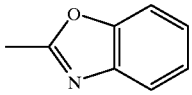 |
|---|---|---|---|---|---|
| —$COOC_2H_5$ | 78-1 | 79-1 | 80-1 | 81-1 | 82-1 |
| —$COCOOC_2H_5$ | 78-2 | 79-2 | 80-2 | 81-2 | 82-2 |
| —$COCH_3$ | — | 79-3 | 80-3 | 81-3 | — |
| —$COCF_3$ | — | 79-4 | 80-4 | 81-4 | — |
| —CHO | — | 79-5 | 80-5 | 81-5 | — |
| —$SO_2CH_3$ | — | 79-6 | 80-6 | 81-6 | — |
| —$SO_2CF_3$ | 78-3 | 79-7 | 80-7 | 81-7 | 82-3 |

-continued
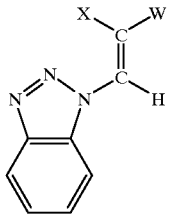
| X | W: —$SO_2CF_3$ | W: —C(=N—$COCH_3$)—$CCH_3$ | W: —C(=N—$SO_2CH_3$)—$CCH_3$ | W: —C(=C(CN)—C(CN))—C—H | W: 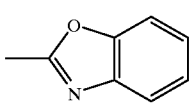 |
|---|---|---|---|---|---|
| —$COCH_2SCH_3$ | 78-4 | 79-8 | 80-8 | 81-8 | — |
| 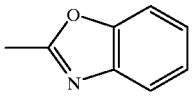 | 78-5 | 79-9 | 80-9 | 81 -9 | 82-4 |
| —$COOCH_2$—$CH_2SCH_3$ | 78-6 | 79-10 | 80-10 | 81-10 | 82-5 |
| —$COCOOCH_2$—$CH_2SCH_3$ | 78-7 | 79-11 | 80-11 | 81-11 | 82-6 |
| —$COCONHCH_2$—$CH_2SCH_3$ | 78-8 | 79-12 | 80-12 | 81-12 | 82-7 |
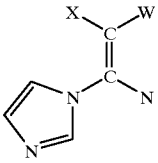
| X | W: —$COCH_3$ | W: —$COCF_3$ | W: —CHO | W: —$COCH_2SCH_3$ | W: —$SO_2CH_3$ |
|---|---|---|---|---|---|
| —$COOC_2H_5$ | 83-1 | 84-1 | 85-1 | 86-1 | 87-1 |
| —$COCOOC_2H_5$ | 83-2 | 84-2 | 85-2 | 86-2 | 87-2 |
| —$COCH_3$ | 83-3 | 84-3 | 85-3 | 86-3 | 87-3 |
| —$COCF_3$ | — | 84-4 | 85-4 | 86-4 | 87-4 |
| —CHO | — | — | 85-5 | 86-5 | 87-5 |
| —$SO_2CH_3$ | — | — | — | 86-6 | 87-6 |
| —$SO_2CF_3$ | 83-4 | 84-5 | 85-6 | 86-7 | 87-7 |
| —$COCH_2SCH_3$ | — | — | — | 86-8 | — |
| 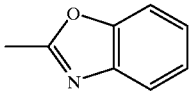 | 83-5 | 84-6 | 85-7 | 86-9 | 87-8 |

-continued
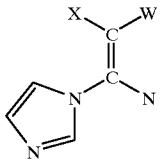
| X | W: —$COCH_3$ | —$COCF_3$ | —CHO | —$COCH_2SCH_3$ | —$SO_2CH_3$ |
|---|---|---|---|---|---|
| —$COOCH_2CH_2SCH_3$ | 83-6 | 84-7 | 85-8 | 86-10 | 87-9 |
| —$COCOOCH_2CH_2SCH_3$ | 83-7 | 84-8 | 85-9 | 86-11 | 87-10 |
| —$COCONHCH_2CH_2SCH_3$ | 83-8 | 84-9 | 85-10 | 86-12 | 87-11 |
25
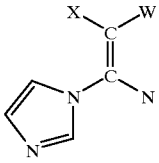
| X | W: —$SO_2CF_3$ | 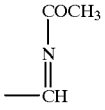 | 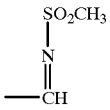 | 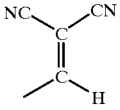 | 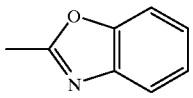 |
|---|---|---|---|---|---|
| —$COOC_2H_5$ | 88-1 | 89-1 | 90-1 | 91-1 | 92-1 |
| —$COCOOC_2H_5$ | 88-2 | 89-2 | 90-2 | 91-2 | 92-2 |
| —$COCH_3$ | — | 89-3 | 90-3 | 91-3 | — |
| —$COCF_3$ | — | 89-4 | 90-4 | 91-4 | — |
| —CHO | — | 89-5 | 90-5 | 91-5 | — |
| —$SO_2CH_3$ | — | 89-6 | 90-6 | 91-6 | — |
| —$SO_2CF_3$ | 88-3 | 89-7 | 90-7 | 91-7 | 92-3 |
| —$COCH_2SCH_3$ | 88-4 | 89-8 | 90-8 | 91-8 | — |
| 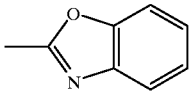 | 88-5 | 89-9 | 90-9 | 91-9 | 92-4 |
| —$COOCH_2CH_2SCH_3$ | 88-6 | 89-10 | 90-10 | 91-10 | 92-5 |
| —$COCOOCH_2CH_2SCH_3$ | 88-7 | 89-11 | 90-11 | 91-11 | 92-6 |

-continued

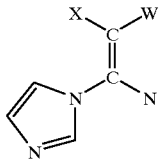

| X | W | | | | |
|---|---|---|---|---|---|
| | —$SO_2CF_3$ | —N(COCH$_3$)=CH | —N($SO_2CH_3$)=CH | NC—C(CN)=C(H)— | 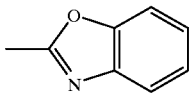 |
| —COCONHCH($CH_2SCH_3$)— | 88-8 | 89-12 | 90-12 | 91-12 | 92-7 |

Further, examples of compounds of formula (G) are shown below.

100-1

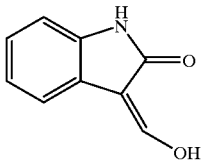

100-2

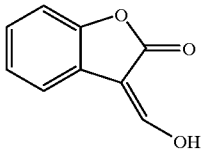

100-3

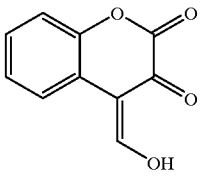

100-4

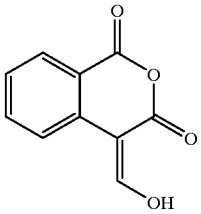

100-5

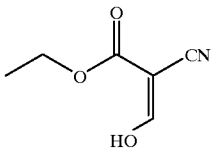

-continued 100-6

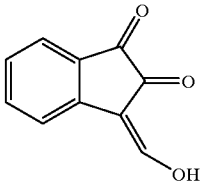

It is preferred to incorporate to the photothermographic material a contrast increase promoting agent (or nucleation promoting agent), including hydroxylamine compounds, alkanolamine compounds and ammonium phthalate compounds described in U.S. Pat. No. 5,545,505; hydroxamic acid compounds described in U.S. Pat. No. 5,545,507; N-acyl-hydrazine compounds described in U.S. Pat. No. 5,558,983; acrylonirile compounds described in U.S. Pat. No. 5,545,515; hydrogen atom donor compounds such as benzhydrol, diphenylphosphine, dialkylpiperidine or alkyl-β-ketoester described in U.S. Pat. No. 5,545,515. Of these are preferred a quaternary onium compound represented by the following formula (P) and an amino compound represented by the following formula (Na):

Formula (P)

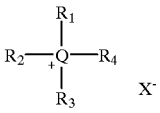

wherein Q is a nitrogen atom or a phosphorus atom; $R_1$, $R_2$, $R_3$ and $R_4$ are each a hydrogen atom or a substituent; $X^-$ is an anion, provided that $R_1$ to $R_4$ may be linked together with each other to form a ring;

Formula (Na)

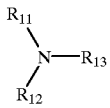

wherein $R_{11}$, $R_{12}$, and $R_{13}$ are each a hydrogen atom, an alkyl group, a substituted alkyl group, an alkenyl group, an a substituted alkenyl group, an alkynyl group, an aryl group, a substituted aryl group, saturated or unsaturated heterocyclic group, provided that $R_{11}$, $R_{12}$ and $R_{13}$ may be linked together with each other to form a ring. Specifically, an aliphatic tertiary amine compound is preferred. These compounds preferably contain a nondiffusible group or a group for promoting adsorption to silver halide. As the nondiffusible group is preferable a ballast group having a molecular weight of at least 100, and more preferably at least 300, including the ballast groups as defined in $A_0$ of formula (H). The group for promoting adsorption to silver halide includes a heterocyclic ring, mercapto group, thione group, and thiourea group.

Further preferred nucleation promoting agent is represented by the following formula (Na2):

Formula (Na2)

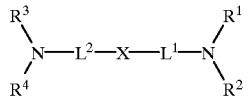

Wherein $R^1$, $R^2$, $R^3$ and $R^4$ are each a hydrogen atom, an alkyl group, substituted alkyl group, an alkenyl group, an a substituted alkenyl group, an alkynyl group, an aryl group, a substituted aryl group, saturated or unsaturated heterocyclic group, and these group may be linked together with each other to form a ring, provided that $R^1$ and $R^2$, or $R^3$ and $R^4$ are not hydrogen atoms at the same time; and X is S, Se or Te. $L_1$ and $L_2$ are each a linkage group and exemplary examples thereof include:

—$CH_2$—, —CH═CH—, —$C_2H_4$—, pyridine-di-yl, —N($Z_1$)—, —O—, —S—, —(CO)—, —($SO_2$)— and —$CH_2O$—, in which Z1 is a hydrogen atom, an alkyl group or an aryl group and these groups each may be substituted.

The linkage group represented by L1 and L2 preferably contain at least one of the following structures:

—[$CH_2CH_2O$]—, —[C($CH_3$)$HCH_2O$]—, —[OC($CH_3$)$HCH_2O$]— and —[$OCH_2C(OH)HCH_2$] —

Exemplary examples of the nucleation promoting agents represented by formula (Na) or (Na2) are shown below, but are not limited to these.

Na-1

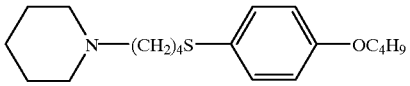

Na-2

$[(C_3H_7)_2N(CH_2)_3OCH_2CH_2]_2S$

Na-3

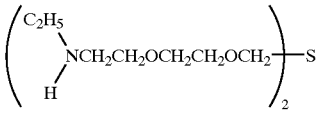

Na-4

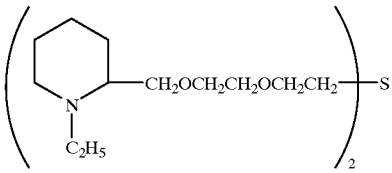

Na-5

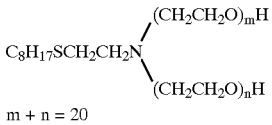

Na-6

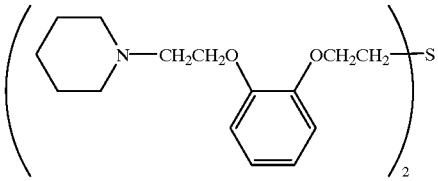

Na-7

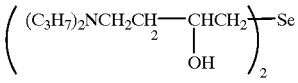

Na-8

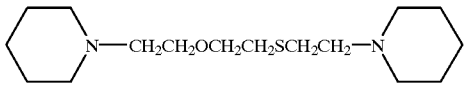

Na-9

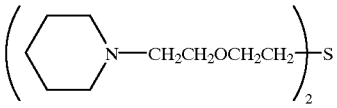

Na-10

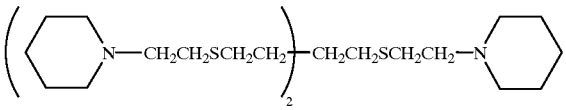

Na-11

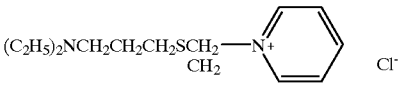

Na-12

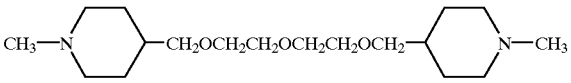

-continued

Na-13

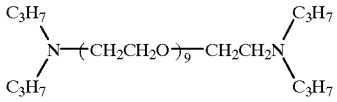

Na-14

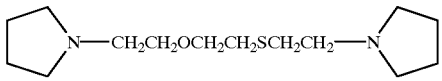

Na-15

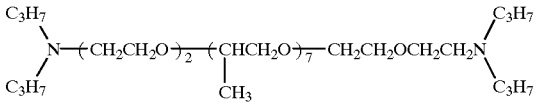

Na-16

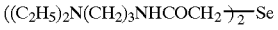

Na-17

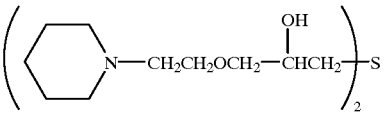

Na-18

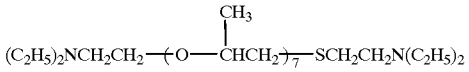

Na-19

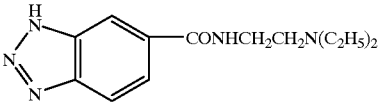

Na-20

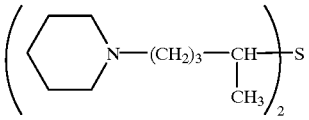

Na-21

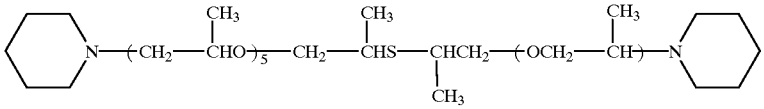

Na-22

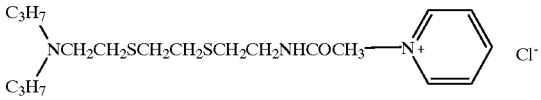

In formula (P), substituents represented by $R_1$ through $R_4$ include an alkyl group (e.g., methyl, ethyl, propyl, butyl, hexyl, cyclohexyl), an alkenyl group (e.g., allyl, butenyl), an alkynyl group (e.g., propargyl, butynyl), an aryl group (e.g., phenyl, naphthyl), a heterocyclic group (e.g., piperidyl, piperazyl, morpholyl, pyridyl, furyl, thienyl, tetrahydrofuryl, tetrahydrothienyl, sulfolanyl) and amino group. Examples of the ring formed by linking of $R_1$ through $R_4$ include a piperidine ring, morpholine ring, piperazine ring, quinuclidine ring, pyridine ring, pyrrole ring, imidazole ring, and tetrazole ring. The group represented by $R_1$ through $R_4$ may be substituted by a substituent, such as a hydroxy group, alkoxyl group, aryloxy group, carboxy group, sulfo group, alkyl group and aryl group. $R_1$, $R_2$, $R_3$ and $R_4$ are preferably a hydrogen atom or an alkyl group. Anions represented by X— include inorganic or organic anions such as halide ion, sulfate ion, nitrate ion, acetate ion, and p-toluenesulfonate ion.

More preferred compounds are represented by the following formulas (Pa), (Pb) and (Pc) or formula (T):

Formula (Pa)

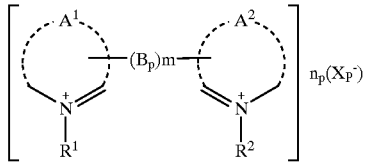

Formula (Pb)

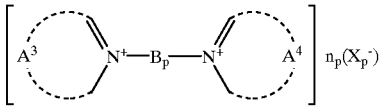

Formular (Pc)

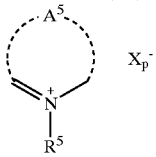

Wherein $A^1$, $A^2$, $A^3$, $A^4$ and $A^5$ are each a nonmetallic atom group necessary to form a nitrogen containing heterocyclic ring, which may further contain an oxygen atom, nitrogen atom and a sulfur atom and which may condense with a benzene ring. The heterocyclic ring formed by $A^1$, $A^2$, $A^3$, $A^4$ or $A^5$ may be substituted by a substituent. Examples of the substituent include an alkyl group, an aryl group, an aralkyl group, alkenyl group, alkynyl group, a halogen atom, an acyl group, an alkoxycarbonyl group, an aryloxycarbonyl group, a sulfo group, hydroxy, an alkoxyl group, an aryloxy group, an amido group, a sulfamoyl group, a carbamoyl group, a ureido group, an amino group, a sulfonamido group, cyano, nitro, a mercapto group, an alkylthio group, and an arylthio group. Exemplary preferred $A^1$, $A^2$, $A^3$, $A^4$ and $A^5$ include a 5- or 6-membered ring (e.g., pyridine, imidazole, thiazole, oxazole, pyrazine, pyrimidine) and more preferred is a pyridine ring.

Bp is a divalent linkage group, and m is 0 or 1. Examples of the divalent linkage group include an alkylene group, arylene group, alkenylene group, —$SO_2$—, —SO—, —O—, —S—, —CO—, —N($R^6$)—, in which $R^6$ is a hydrogen atom, an alkyl group or aryl group. These groups may be included alone or in combination. Of these, Bp is preferably an alkylene group or alkenylene group.

$R^1$, $R^2$ and $R^5$ are each an alkyl group having 1 to 20 carbon atoms, and $R^1$ and $R^2$ may be the same. The alkyl group may be substituted and substituent thereof are the same as defined in $A^1$, $A^2$, $A^3$, $A^4$ and $A^5$. Preferred $R^1$, $R^2$ and $R^5$ are each an alkyl group having 4 to 10 carbon atoms, and more preferably an aryl-substituted alkyl group, which may be substituted.

$X_p^-$ is a counter ion necessary to counterbalance overall charge of the molecule, such as chloride ion, bromide ion, iodide ion, sulfate ion, nitrate ion and p-toluenesulfonate; $n_p$ is a counter ion necessary to counterbalance overall charge of the molecule and in the case of an intramolecular salt, $n_p$ is 0.

Formula (T)

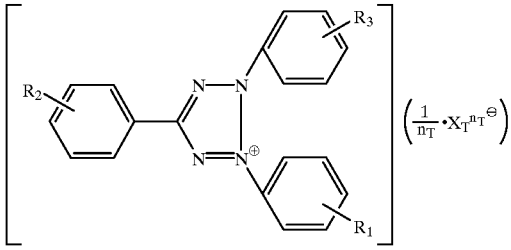

Each of $R_1$, $R_2$ and $R_3$ is preferably a hydrogen atom or a group, of which Hammett's σ-value exhibiting a degree of electron attractiveness is negative.

The σ values of the phenyl substituents are disclosed in lots of reference books. For example, a report by C.Hansch in "The Journal of Medical Chemistry", vol.20, on page 304(1977), etc. can be mentioned. Groups showing particularly preferable negative σ-values include, for example, methyl group($\sigma_p$=−0.17, and in the following, values in the parentheses are in terms of $\sigma_p$ value), ethyl group(−0.15), cyclopropyl group(−0.21), n-propyl group(−0.13), isopropyl group(−0.15), cyclobutyl group(−0.15), n-butyl group (−0.16), iso-butyl group(−0.20), n-pentyl group(−0.15), n-butyl group(−0.16), iso-butyl group(−0.20), n-pentyl group(−0.15), cyclohexyl group(−0.22), hydroxyl group(−0.37), amino group(−0.66), acetylamino group(−0.15), butoxy group(−0.32), pentoxy group(−0.34), etc. can be mentioned. All of these groups are useful as the substituent for the compound represented by the formula T according to the present invention; n is 1 or 2, and as anions represented by $X^{nT-}_T$ for example, halide ions such as chloride ion, bromide ion, iodide ion, etc.; acid radicals of inorganic acids such as nitric acid, sulfuric acid, perchloric acid, etc.; acid radicals of organic acids such as sulfonic acid, carboxylic acid, etc.; anionic surface active agents, including lower alkyl benzenesulfonic acid anions such as p-toluenesulfonic anion, etc.; higher alkylbenzene sulfonic acid anions such as p-dodecyl benzenesulfonic acid anion, etc.; higher alkyl sulfate anions such as lauryl sulfate anion, etc.; Boric acid-type anions such as tetraphenyl borone, etc.; dialkylsulfo succinate anions such as di-2-ethylhexylsulfo succinate anion, etc.; higher fatty acid anions such as cetyl polyethenoxysulfate anion, etc.; and those in which an acid radical is attached to a polymer, such as polyacrylic acid anion, etc. can be mentioned.

Exemplary examples of the quaternary onium compounds are shown below, but are not limited to these.

P-1

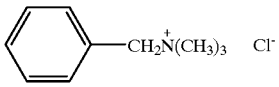

P-2

$C_{16}H_{33}\overset{+}{N}(CH_3)_3$ $Br^-$

P-3

$\overset{+}{N}(C_4H_9)_4$ $Cl^-$

P-4

$(CH_3)_3\overset{+}{N}CH_2CH_2OH$ $Cl^-$

P-5

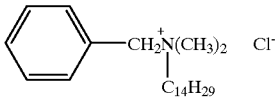

P-6

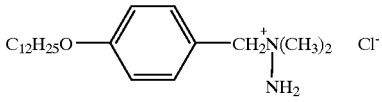

-continued
P-7
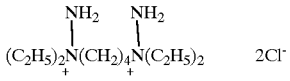
P-8
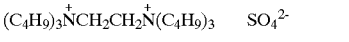
P-9
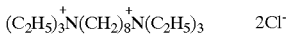
P-10
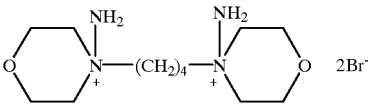
P-11
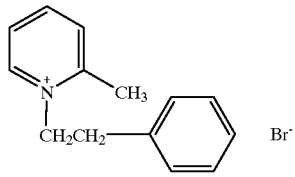
P-12
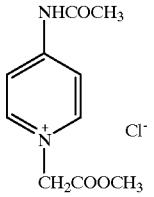
P-13
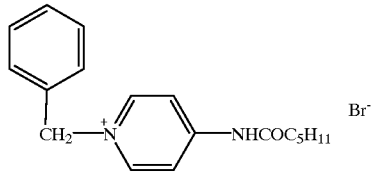
P-14
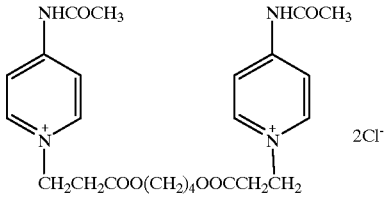
P-15
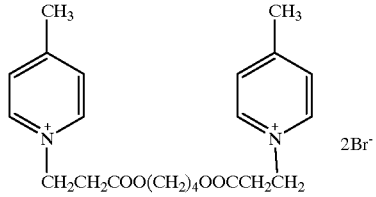
P-16
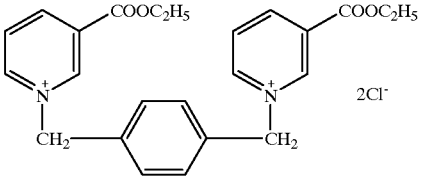
P-17
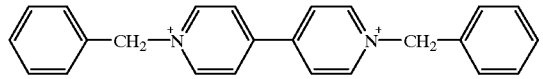
P-18
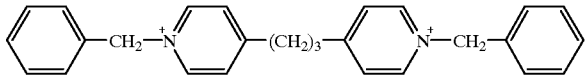
P-19
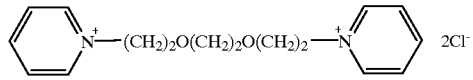
P-20
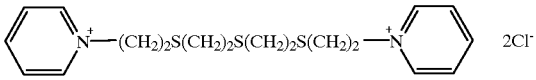
P-21
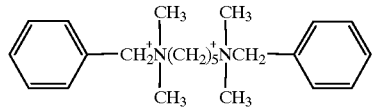
P-22
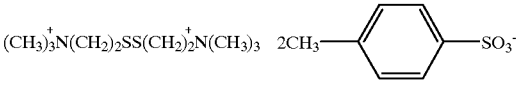
P-23
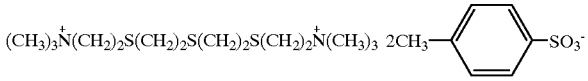
P-24
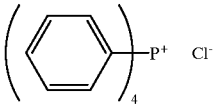
P-25
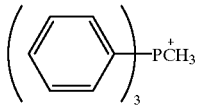
P-26
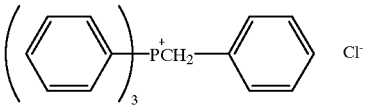
P-27
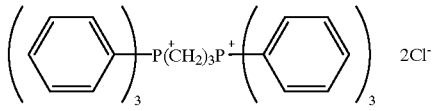
P-28
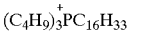

-continued
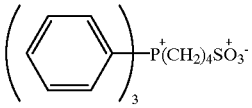
P-29
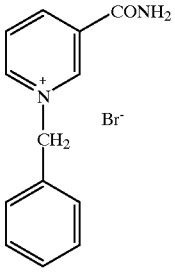
P-30
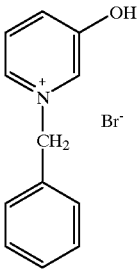
P-31
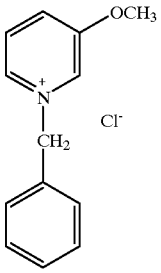
P-32
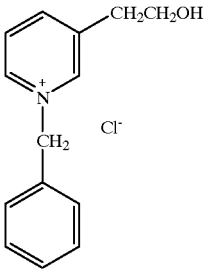
P-33
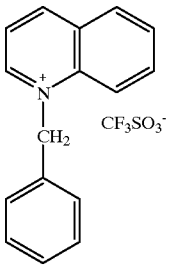
P-34
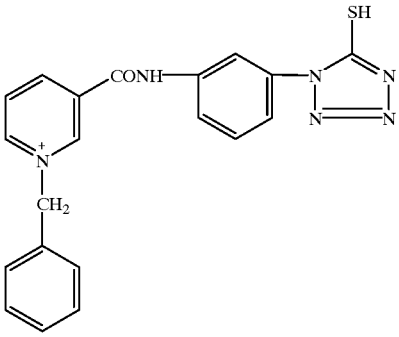
P-35
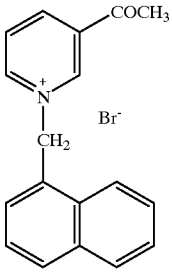
P-36
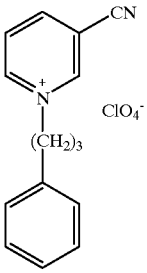
P-37
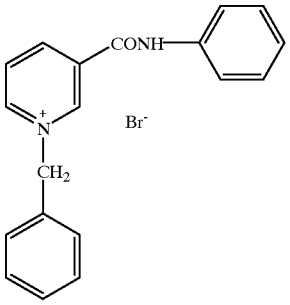
P-38

-continued
P-39
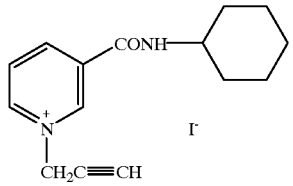
P-40
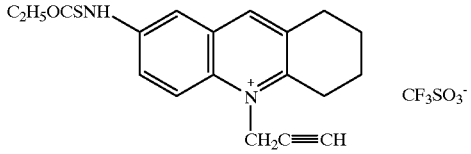
P-41
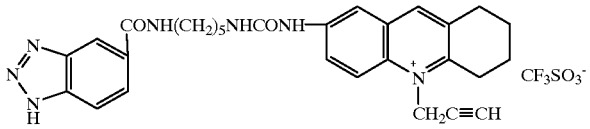
P-42
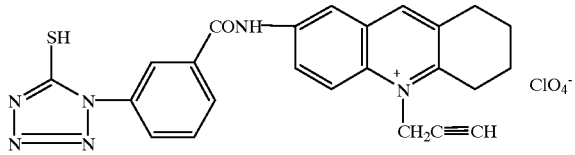
P-43
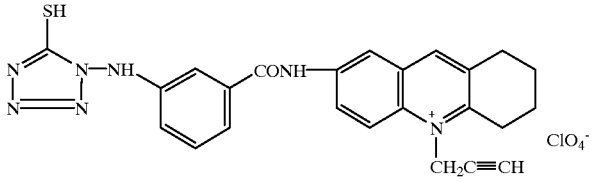
P-44
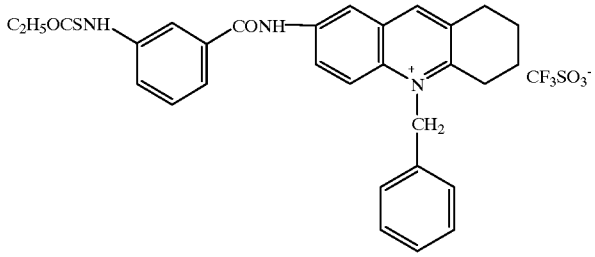
P-45
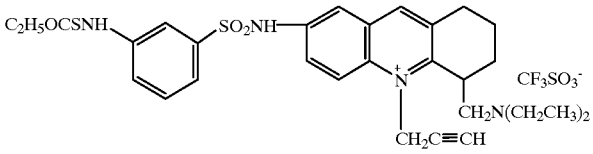
P-46
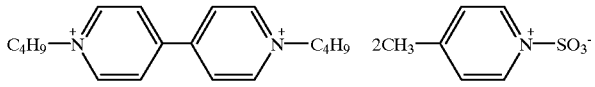
P-47
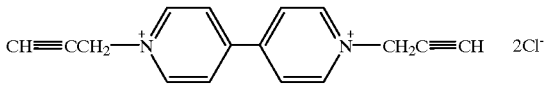
P-48
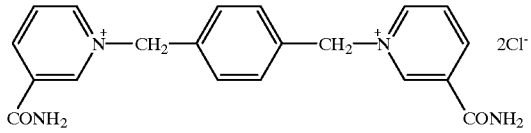
P-49
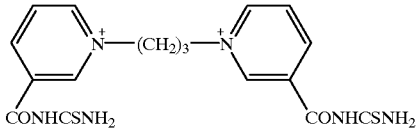
P-50
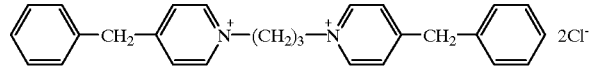
P-51
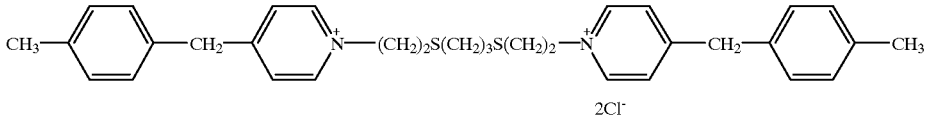
P-52
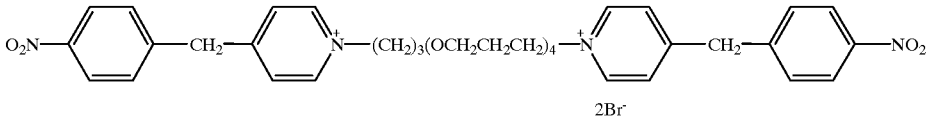
P-53
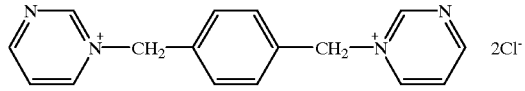
P-54
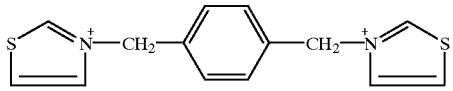

-continued

P-55

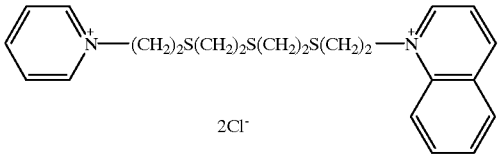

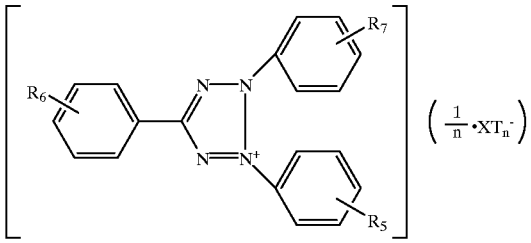

| Compd. No. | $R_5$ | $R_6$ | $R_7$ | $X_T^{n-}$ |
|---|---|---|---|---|
| T-1 | H | H | p-$CH_3$ | – |
| T-2 | p-$CH_3$ | H | p-$CH_3$ | $Cl^-$ |
| T-3 | p-$CH_3$ | p-$CH_3$ | p-$CH_3$ | $Cl^-$ |
| T-4 | H | p-$CH_3$ | p-$CH_3$ | $Cl^-$ |
| T-5 | p-$OCH_3$ | p-$CH_3$ | p-$CH_3$ | $Cl^-$ |
| T-6 | p-$OCH_3$ | H | p-$CH_3$ | $Cl^-$ |
| T-7 | p-$OCH_3$ | H | p-$OCH_3$ | $Cl^-$ |
| T-8 | m-$C_2H_5$ | H | m-$C_2H_5$ | $Cl^-$ |
| T-9 | p-$C_2H_5$ | p-$C_2H_5$ | p-$C_2H_5$ | $Cl^-$ |
| T-10 | p-$C_3H_7$ | H | p-$C_3H_7$ | $Cl^-$ |
| T-11 | p-iso$C_3H_7$ | H | p-iso$C_3H_7$ | $Cl^-$ |
| T-12 | p-$OC_2H_5$ | H | p-$OC_2H_5$ | $Cl^-$ |
| T-13 | p-$OCH_3$ | H | p-iso$C_3H_7$ | $Cl^-$ |
| T-14 | H | H | p-n$C_{12}H_{25}$ | $Cl^-$ |
| T-15 | p-n$C_{12}H_{25}$ | H | p-n$C_{12}H_{25}$ | $Cl^-$ |
| T-16 | H | p-$NH_2$ | H | $Cl^-$ |
| T-17 | p-$NH_2$ | H | H | $Cl^-$ |
| T-18 | p-$CH_3$ | H | p-$CH_3$ | $ClO_4^-$ |

The quaternary onium compounds described above can be readily synthesized according to the methods commonly known in the art. For example, the tetrazolium compounds described above may be referred to Chemical Review 55, page 335–483.

The quaternary onium compound is incorporated preferably in an amount of $1\times10^{-8}$ to 1 mole, and $1\times10^{-7}$ to $1\times10^{-1}$ mole per mole of silver halide, which may be incorporated to a photothermographic material at any time from during silver halide grain formation and to coating.

The quaternary onium compound and the amino compound may be used alone or in combination. These compounds may be incorporated into any component layer of the photothermographic material, preferably a component layer provided on the photosensitive layer-side, and more preferably a photosensitive layer and/or its adjacent layer.

Photothermographic materials used in the invention may contain an image toning agent to modify tone of silver images produced upon reaction of an organic silver salt and a reducing agent in exposed areas to provide black images. Examples of preferred image toning agents are disclosed in Research Disclosure Item 17029, and include the following: imides (for example, phthalimide), cyclic imides, pyrazoline-5-one, and quinazolinone (for example, succinimide, 3-phenyl-2-pyrazoline-5-on, 1-phenylurazole, quinazoline and 2,4-thiazolidione); naphthalimides (for example, N-hydroxy-1,8-naphthalimide); cobalt complexes (for example, cobalt hexaminetrifluoroacetate), mercaptans (for example, 3-mercapto-1,2,4-triazole); N-(aminomethyl) aryldicarboxyimides (for example, N-(dimethylaminomethyl)phthalimide); blocked pyrazoles, isothiuronium derivatives and combinations of certain types of light-bleaching agents (for example, combination of N,N'-hexamethylene(1-carbamoyl-3,5-dimethylpyrazole), 1,8-(3,6-dioxaoctane)bis-(isothiuroniumtrifluoroacetate), and 2-(tribromomethyl-sulfonyl)benzothiazole; merocyanine dyes (for example, 3-ethyl-5-((3-etyl-2-benzothiazolinylidene(benzothiazolinylidene))-1-methylethylidene-2-thio-2,4-oxazolidinedione); phthalazinone, phthalazinone derivatives or metal salts thereof (for example, 4-(1-naphthyl)phthalazinone, 6-chlorophthalazinone, 5,7-dimethylphthalazinone, and 2,3-dihydro-1,4-phthalazinedione); combinations of phthalazinone and sulfinic acid derivatives (for example, 6-chlorophthalazinone and benzenesulfinic acid sodium, or 8-methylphthalazinone and p-trisulfonic acid sodium); combinations of phthalazine and phthalic acid; combinations of phthalazine (including phthalazine addition products) with at least one compound selected from maleic acid anhydride, and phthalic acid, 2,3-naphthalenedicarboxylic acid or o-phenylenic acid derivatives and anhydrides thereof (for example, phthalic acid, 4-methylphthalic acid, 4-nitrophthalic acid, and tetrachlorophthalic acid anhydride); quinazolinediones, benzoxazine, naphthoxazine derivatives, benzoxazine-2,4-diones (for example, 1,3-benzoxazine-2,4-dione); pyrimidines and asymmetry-triazines (for example, 2,4-dihydroxypyrimidine), and tetraazapentalene derivatives (for example, 3,6-dimercapto-1,4-diphenyl-1H, 4H-2,3a,5,6a-tatraazapentalene). Preferred image color control agents include phthalazone or phthalazine.

There may be incorporated mercapto compounds, disulfide compounds and thione compounds to control development by acceleration or retardation thereof, to enhance spectral sensitization efficiency and to enhance storage stability before and after development.

Of mercapto compounds are preferred those which are represented by the following formulas:

Ar—SM or Ar—S—S—Ar wherein M is a hydrogen atom or an alkali metal atom; Ar is an aromatic ring or condensed aromatic ring containing a nitrogen atom, oxygen atom, sulfur atom, selenium atom or tellurium atom. Such aromatic heterocyclic rings are preferably benzimidazole, naphthoimidazole, benzthiazole, naphthothiazole, benzoxazole, naphthooxazole, benzoselenazole, benzotellurazole, imidazole, oxazole, pyrazole, triazole, triazines, pyrimidine, pyridazine, pyrazine, pyridine, purine, and quinoline. The aromatic heterocyclic rings described above may be substituted with a halogen atom (e.g., Cl, Br, I), a hydroxy group, an amino group, a carboxy group, an alkyl group (having one or more carbon atoms, and preferablyl to 4 carbon atoms) or an alkoxy group (having one or more carbon atoms, and preferablyl to 4 carbon atoms). Examples of mercapto-substituted heterocyclic compounds include 2-mercaptobebzimidazole, 2-mercaptobenzoxazole, 2-mercaptobenzthiazole, 2-mercapto-5-methylbenzthiazole, 3-mercapto-1,2,4-triazole, 2-mercaptoquinoline, 8-mercaptopurine, 2,3,5,6-tetrachloro-4-pyridinethiol, 4-hydroxy-2-mercaptopyridine, and 2-mercapto-4-phenyloxazole. However, the compounds are not limited to these examples.

Antifoggants may be incorporated into the photothermographic material used invention. The substance which is known as the most effective antifoggant is a mercury ion. The incorporation of mercury compounds as the antifoggant into photosensitive materials is disclosed, for example, in U.S. Pat. No. 3,589,903. However, mercury compounds are not environmentally preferred. As mercury-free antifoggants, preferred are those antifoggants as disclosed in U.S. Pat. Nos. 4,546,075 and 4,452,885, and JP-A 59-57234 and 4-232939.

Particularly preferred mercury-free antifoggants are heterocyclic compounds having at least one substituent, represented by —C(X1)(X2)(X3) (wherein X1 and X2 each represent halogen, and X3 represents hydrogen or halogen), as disclosed in U.S. Pat. Nos. 3,874,946 and 4,756,999. Examples of suitable antifoggants include those described in JP-A 9-2883328, col. [0030] to [0036]. As examples of suitable antifoggants, employed preferably are compounds described in paragraph numbers [0062] and [0063] of JP-A. 9-90550. Furthermore, other suitable antifoggants are disclosed in U.S. Pat. No. 5,028,523, and European Patent 600,587, 605,981 and 631,176.

In the photothermographic material used in invention, employed can be sensitizing dyes described, for example, in JP-A 63-159841, 60-140335, 63-231437, 63-259651, 63-304242, and 63-15245; U.S. Pat. Nos. 4,639,414, 4,740,455, 4,741,966, 4,751,175, and 4,835,096. Useful sensitizing dyes employed in the present invention are described, for example, in publications described in or cited in Research Disclosure Items 17643, Section IV-A (page 23, December 1978). Particularly, selected can advantageously be sensitizing dyes having the spectral sensitivity suitable for spectral characteristics of light sources of various types of scanners. For example, compounds described in JP-A 9-34078, 9-54409 and 9-80679 are preferably employed.

Binders suitable for the photothermographic material used in the invention are transparent or translucent, and generally colorless. Binders are natural polymers, synthetic resins, and polymers and copolymers, other film forming media; for example, gelatin, gum arabic, poly(vinyl alcohol), hydroxyethyl cellulose, cellulose acetate, cellulose acetatebutylate, poly(vinyl pyrrolidone), casein, starch, poly (acrylic acid), poly(methyl methacrylic acid), poly(vinyl chloride), poly(methacrylic acid), copoly(styrene-maleic acid anhydride), copoly(styrene-acrylonitrile, copoly (styrene-butadiene, poly(vinyl acetal) series [e.g., poly(vinyl formal) and poly(vinyl butyral), polyester series, polyurethane series, phenoxy resins, poly(vinylidene chloride), polyepoxide series, polycarbonate series, poly(vinyl acetate) series, cellulose esters, poly(amide) series. Of these binders are preferred aqueous-insoluble polymers such as cellulose acetate, cellulose acetate-butylate and poly(vinyl butyral); and poly(vinyl formal) and poly(vinyl butyral) are specifically preferred as a polymer used in the thermally developable photosensitive layer; and cellulose acetate and cellulose acetate-butylate are preferably used in a protective layer and backing layer.

The amount of the binder in a photosensitive layer is preferably between 1.5 and 6 g/m$^2$, and is more preferably between 1.7 and 5 g/m$^2$. The binder content of less than 1.5 g/m$^2$ tends to increase a density of unexposed area to levels unacceptable to practical use.

In the present invention, a matting agent is preferably incorporated into the image forming layer side. In order to minimize the image abrasion after thermal development, the matting agent is provided on the surface of a photosensitive material and the matting agent is preferably incorporated in an amount of 0.5 to 30 per cent in weight ratio with respect to the total binder in the emulsion layer side.

In cases where a non photosensitive layer is provided on the opposite side of the support to the photosensitive layer, it is preferred to incorporate a matting agent into at least one of the non-photosensitive layer (and more preferably, into the surface layer) in an amount of 0.5 to 40% by weight, based on the total binder on the opposite side to the photosensitive layer.

Materials of the matting agents employed in the present invention may be either organic substances or inorganic substances. Examples of the inorganic substances include silica described in Swiss Patent No. 330,158, etc.; glass powder described in French Patent No. 1,296,995, etc.; and carbonates of alkali earth metals or cadmium, zinc, etc. described in U.K. Patent No. 1.173,181, etc. Examples of the organic substances include starch described in U.S. Pat. No. 2,322,037, etc.; starch derivatives described in Belgian Patent No. 625,451, U.K. Patent No. 981,198, etc.; polyvinyl alcohols described in Japanese Patent Publication No. 44-3643, etc.; polystyrenes or polymethacrylates described in Swiss Patent No. 330,158, etc.; polyacrylonitriles described in U.S. Pat. No. 3,079,257, etc.; and polycarbonates described in U.S. Pat. No. 3,022,169.

The shape of the matting agent may be crystalline or amorphous. However, a crystalline and spherical shape is preferably employed. The size of a matting agent is expressed in the diameter of a sphere having the same volume as the matting agent. The particle diameter of the matting agent in the present invention is referred to the diameter of a spherical converted volume. The matting agent employed in the present invention preferably has an average particle diameter of 0.5 to 10 $\mu$m, and more preferably of 1.0 to 8.0 $\mu$m. Furthermore, the variation coefficient of the size distribution is preferably not more than 50 percent, is more preferably not more than 40 percent, and is most preferably not more than 30 percent. The variation coefficient of the size distribution as described herein is a value represented by the formula described below:

(Standard deviation of particle diameter)/(average particle diameter)×100

The matting agent according to the present invention can be incorporated into any layer. In order to accomplish the object of the present invention, the matting agent is preferably incorporated into the layer other than the photosensitive layer layer, and is more preferably incorporated into the farthest layer from the support.

Addition methods of the matting agent include those in which a matting agent is previously dispersed into a coating composition and is then coated, and prior to the completion of drying, a matting agent is sprayed. When plural matting agents are added, both methods may be employed in combination.

In addition to these materials, a variety of adjuvants may be incorporated into the photosensitive layer, non-photosensitive layer or other layer(s). Exemplarily, a surfactant, an antioxidant, a stabilizer, a plasticizer, a UV absorbent or a coating aid may be incorporated. As these adjuvants and other additives can be used compounds described in RD17029 (June, 1978, page 9–15).

Supports usable in the photothermographic materials include various kinds of polymeric materials, glass, wool fabric, cotton fabric, paper, metal (e.g., aluminum) and those which are convertible to flexible sheets or rolls are preferred in terms of handling as information recording material. Preferred supports usable in photothermographic materials are plastic resin films (e.g., cellulose acetate film, polyester film, polyethylene terephthalate film, polyethylene naphthalate film, polyamide film, polyimide film, cellulose triacetate film, polycarbonate film) and biaxially stretched polyethylene terephthalate film is specifically preferred. The thickness of the support is preferably 50 to 300 $\mu$m, and more preferably 70 to 180 $\mu$m.

In the present invention, to improve an electrification property, a conducting compound such as a metal oxide and/or a conducting polymer can be incorporated into a construction layer. These compounds can be incorporated into any layer, preferably into a sublayer, a backing layer and an intermediate layer between a photosensitive layer and a sublayer, etc. In the present invention, the conducting compounds described in U.S. Pat. No. 5,244,773, column 14 through 20, are preferably used.

The coating method of the photosensitive layer, protective layer and backing layer is not specifically limited. Coating can be conducted by any method known in the art, including air knife, dip-coating, bar coating, curtain coating, and hopper coating. Two or more layers can be simultaneously coated. As a solvent for coating solution are employed organic solvents such as methyl ethyl ketone (also denoted as MEK), ethyl acetate and toluene.

The photothermographic material used in the invention comprises a support having thereon a photosensitive layer, and preferably further on the photosensitive layer having a non-photosensitive layer. For example, it is preferred that a protective layer is provided on the photosensitive layer to protect the photosensitive layer and that a back coating layer is provided on the opposite side of the support to the photosensitive layer to prevent adhesion between photosensitive materials or sticking of the photosensitive material to a roller. Further, there may be provided a filter layer on the same side or opposite side to the photosensitive layer to control the amount or wavelengths of light transmitting the thermally developable photosensitive layer. Alternatively, a dye or pigment may be incorporated into the photosensitive layer. In this case, dyes described in JP-A 8-201959 are preferably used therein. The photosensitive layer may be comprised of plural layers. To adjust contrast, a high speed layer and low speed layer may be provided in combination. Various adjuvants may be incorporated into the photosensitive layer, non-photosensitive layer or other component layer(s).

The photothermographic material, which is stable at ordinary temperatures, is exposed and heated at a high temperature (preferably 80 to 200° C., and more preferably 100 to 150° C.) to undergo development. In cases when heated at a temperature of lower than 80° C., sufficient image density can be obtained within a short time. Further, in cases when heated at a temperature of higher than 200° C., a binder melts and is transferred to a roller, adversely affecting not only images but also transportability and a developing machine. The organic silver salt (functioning as an oxidant) and the reducing agent undergo oxidation-reduction reaction upon heating to form silver images. The reaction process proceeds without supplying any processing solution such as water.

Any light source within the infrared region is applicable to exposure of the photothermographic material, and infrared semiconductor lasers (780 nm, 820 nm) are preferred in terms of high power and transmission capability through the photosensitive material.

In the invention, exposure is preferably conducted by laser scanning exposure. It is also preferred to use a laser exposure apparatus, in which a scanning laser light is not exposed at an angle substantially vertical to the exposed surface of the photosensitive material. The expression "laser light is not exposed at an angle substantially vertical to the exposed surface" means that laser light is exposed preferably at an angle of 55 to 88°, more preferably 60 to 86°, still more preferably 65 to 84°, and optimally 70 to 82°. When the photosensitive material is scanned with laser light, the beam spot diameter on the surface of the photosensitive material is preferably not more than 200 $\mu$m, and more preferably not more than 100 $\mu$m. Thus, a smaller spot diameter preferably reduces the angle displacing from verticality of the laser incident angle. The lower limit of the beam spot diameter is 10 $\mu$m. The thus laser scanning exposure can reduce deterioration in image quality due to reflected light, resulting in occurrence such as interference fringe-like unevenness.

Exposure applicable in the invention is conducted preferably using a laser scanning exposure apparatus producing longitudinally multiple scanning laser beams, whereby deterioration in image quality such as occurrence of interference fringe-like unevenness is reduced, as compared to a scanning laser beam of the longitudinally single mode. Longitudinal multiplication can be achieved by a technique of employing backing light with composing waves or a technique of high frequency overlapping. The expression "longitudinally multiple"means that the exposure wavelength is not a single wavelength. The exposure wavelength distribution is usually not less than 5 nm and not more than 10 nm. The upper limit of the exposure wavelength distribution is not specifically limited but is usually about 60 nm.

The image forming apparatus according to the invention comprising an image data processing section to process image data or an exposure condition setting section to set an exposure so that an image size is enlarged or reduced to compensate a dimensional change of the photothermographic material between before and after being subjected to thermal development, condition; an exposure section to imagewise expose the photothermographic material to laser based on the processed image data or the set exposure condition; and a thermal development section to subject the photothermographic material to thermal development; or the image forming apparatus comprising an image data processing section to process image data or an exposure condition setting section to set an exposure so that an image size is enlarged or reduced to correspond to characteristics of a thermal development section; an exposure section to imagewise expose the photothermographic material to laser based on the processed image data or the set exposure condition; and a thermal development section to subject the photothermographic material to thermal development.

In this case, it is preferred that the exposure section and the thermal development section are provided together with each other. The image data processing section or the exposure condition setting section preferably include various kinds of computers, CPU, IC or LSI. The exposure section comprises (i) a rotation drum, around the external periphery of which a photothermographic material are wound or a rotating drum, around internal periphery of which the photothermographic material is placed and a rotating mirror, and (ii) a laser light source. The thermal development section comprises a heated roller or heated drum.

It is preferred that the image forming apparatus comprises an input section, such as keyboard or button to input the data regarding a dimensional change between before and after thermal development of a photothermographic material or the data regarding characteristics of the thermal development section such as temperature non-uniformity in the thermal development section, and a detection section to detect a dimensional change between before and after thermal development of a photothermographic material or characteristics of the thermal development section such as temperature non-uniformity in the thermal development section.

EXAMPLES

The present invention will be further described based on examples but embodiments of the invention are by no means limited to these examples.

Example 1

Preparation of a Subbed PET Photographic Support

Polyethylene terephthalate (also denoted as PET) pellets are dried at 130° C. for 4 hrs., then melted at 300° C., extruded through a T-type die and rapidly cooled to prepare non-stretched film. Using rolls different in circumferential speed, the film was longitudinally stretched by 3.0 time at a temperature of 110° C. and then was laterally stretched by 4.5 times at 130° C. using a tenter. The stretched film was thermally fixed at 240° C. for a period of 20 seconds and then further subjected to thermal relaxation by 4% in the lateral direction. After slitting chuck portions of the tenter, both edges of the film were subjected to the knurling treatment and wound up at 4 kg/cm$^2$. The thus obtained PET film in roll was 2.4 m wide, 800 m long and 100 $\mu$m thick. A PET support of 110, 120, 150 or 175 $\mu$m thick was prepared by adjusting the thickness of non-stretched film and subjecting to treatments similar to the 100 $\mu$m thick support.

Both surfaces of each of five PET films described above was subjected to corona discharging at 8 w/m$^2$·min. Onto the surface of one side, the subbing coating composition a-1 described below was applied so as to form a dried layer thickness of 0.8 $\mu$m, which was then dried. The resulting coating was designated Subbing Layer A-1. Onto the opposite surface, the subbing coating composition b-1 described below was applied to form a dried layer thickness of 0.8 $\mu$m. The resulting coating was designated Subbing Layer B-1.

Subbing Coating Composition a-1

| | |
|---|---|
| Latex solution (solid 30%) of a copolymer consisting of butyl acrylate (30 weight %), t-butyl acrylate (20 weight %) styrene (25 weight %) and 2-hydroxy ethyl acrylate (25 weight %) | 270 g |
| (C-1) | 0.6 g |
| Hexamethylene-1,6-bis(ethyleneurea) | 0.8 g |
| Polystyrene fine particles (av. Size 3 $\mu$m) | 0.05 g |

-continued

| | |
|---|---|
| Colloidal silica (av. size 90 $\mu$m) | 0.1 g |
| Water to make | 1 liter |

Subbing Coating Composition b-1

| | |
|---|---|
| $SnO_2$/Sb (9/1 by weight, av. Size 0.18 $\mu$m) | 200 mg/m$^2$ |
| Latex liquid (solid portion of 30%) of a copolymer consisting of butyl acrylate (40 weight %) styrene (20 weight %) glycidyl acrylate (40 weight %) | 270 g |
| (C-1) | 0.6 g |
| Hexamethylene-1,6-bis(ethyleneurea) | 0.8 g |
| Water to make | 1 liter |

Subsequently, the surfaces of Subbing Layers A-1 and B-1 were subjected to corona discharging with 8 w/m$^2$·minute. Onto the Subbing Layer A-1, the upper subbing layer coating composition a-2 described below was applied so as to form a dried layer thickness of 0.8 $\mu$m, which was designated Subbing Layer A-2, while onto the Subbing Layer B-1, the upper subbing layer coating composition b-2 was applied so at to form a dried layer thickness of 0.8 $\mu$m, having a static preventing function, which was designated Subbing Upper Layer B-2.

Upper Subbing Layer Coating Composition a-2

| Gelatin in an amount (weight) to make 0.4 g/m$^2$ | |
|---|---|
| (C-1) | 0.2 g |
| (C-2) | 0.2 g |
| (C-3) | 0.1 g |
| Silica particles (av. size 3 $\mu$m) | 0.1 g |
| Water to make | 1 liter |

Upper Subbing Layer Coating Composition b-2

| | |
|---|---|
| (C-4) | 60 g |
| Latex solution (solid 20% comprising) (C-5) as a substituent | 80 g |
| Ammonium sulfate | 0.5 g |
| (C-6) | 12 g |
| Polyethylene glycol (average molecular weight of 600) | 6 g |
| Water to make | 1 liter |

(C-1)

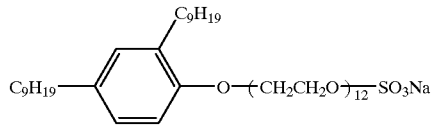

(C-2)

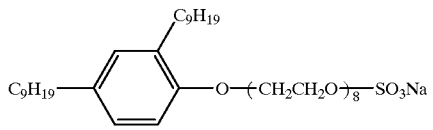

-continued (C-3)

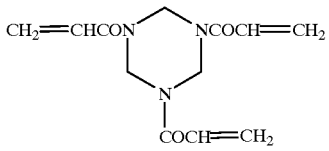

(C-4)

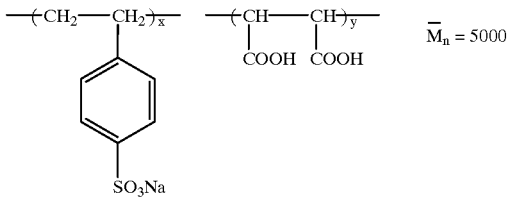

($\overline{M}$n is a number average molecular weight) x:y=75:25 (weight ratio)

(C-5)

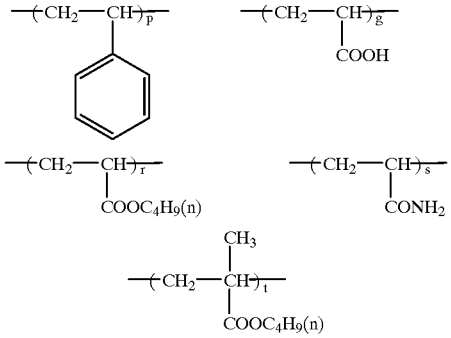

p:g:r:s:t=40:5:10:5:40 (weight ratio)

C-6

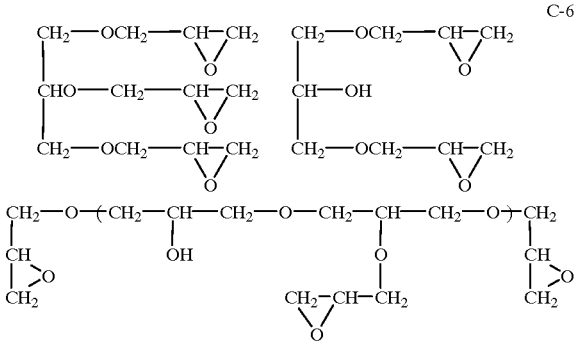

Preparation of Photosensitive Silver Halide Emulsion A

In 900 ml of deionized water were dissolved 7.5 g of gelatin and 10 mg of potassium bromide. After adjusting the temperature and the pH to 35° C. and 3.0, respectively, 370 ml of an aqueous solution containing 74 g silver nitrate and an equimolar aqueous solution containing sodium chloride, potassium bromide, potassium iodide (in a molar ratio of 60/38/2), and $1\times10^{-6}$ mol/mol Ag of $[Ir(NO)Cl_5]$ and $1\times10^{-6}$ mol/mol Ag of rhodium chloride were added by the controlled double-jet method, while the pAg was maintained at 7.7. Thereafter, 4-hydroxy-6-methyl-1,3,3a,7-tetraazaindene was added and the pH was adjusted to 5 using NaOH. There was obtained cubic silver iodobromochloride grains having an average grain size of 0.06 μm, a variation coefficient of the projection area equivalent diameter of 10 percent, and the proportion of the {100} face of 87 percent. The resulting emulsion was flocculated to remove soluble salts, employing a flocculating agent.

Preparation of Sodium Behenate Solution

In 945 ml water were dissolved 32.4 g of behenic acid, 9.9 g of arachidic acid and 5.6 g of stearic acid at 90° C. Then, after adding 98 ml of 1.5M aqueous sodium hydroxide solution with stirring and further adding 0.93 ml of concentrated nitric acid, the solution was cooled to a temperature of 55° C. to obtain an aqueous sodium behenate solution.

Preparation of Pre-formed Emulsion of Silver Behenate and Silver Halide Emulsion A To the aqueous sodium behenate solution described above was added 15.1 g of silver halide emulsion A. After adjusting the pH to 8.1 with aqueous sodium hydroxide, 147 ml of aqueous 1M silver nitrate solution was added thereto in 7 min and after stirring for 20 min., soluble salts were removed by ultrafiltration. Thus obtained silver behenate was comprised of monodisperse particles having an average particle size of 0.8 μm and a monodisperse degree (i.e., variation coefficient of particle size) of 8%. After forming flock of the dispersion, water was removed therefrom and after washing and removal of water were repeated six times, drying was conducted.

Preparation of Photosensitive Emulsion

To a half of the thus prepared pre-formed emulsion were gradually added 544 g of methyl ethyl ketone solution of 17 wt % polyvinyl butyral (average molecular weight of 3,000) and 107 g of toluene. Further, the mixture was dispersed by a media dispersing machine using 0.5 mm $ZrO_2$ beads mill and at 4,000 psi and 30° C. for 10 min.

On both sides of the support described above, the following layers were simultaneously coated to prepare photothermographic material Samples 101 to 105. Drying was conducted at 60° C. for 15 min.

Back Coating

On the B-1 layer of the support, the following composition was coated.

| | |
|---|---|
| Cellulose acetate-butylate (10% methyl ethyl ketone solution) | 15 ml/m$^2$ |
| Dye-A | 7 mg/m$^2$ |
| Dye-B | 7 mg/m$^2$ |
| Matting agent: monodisperse silica having a monodisperse degree of 15% and average size of 8 μm | 90 mg/m$^2$ |
| $C_8F_{17}(CH_2CH_2O)_{12}C_8H_{17}$ | 50 mg/m$^2$ |
| $C_9F_{19}$—$C_6H_4$—$SO_3Na$ | 10 mg/m$^2$ |

Dye-A

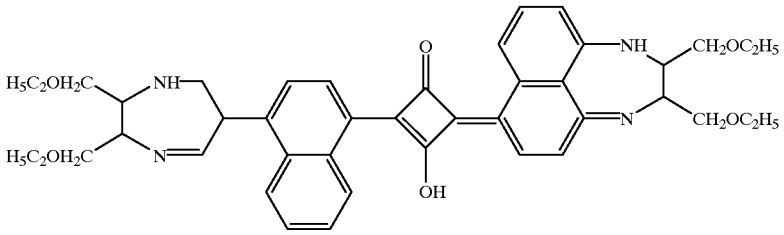

Dye-B

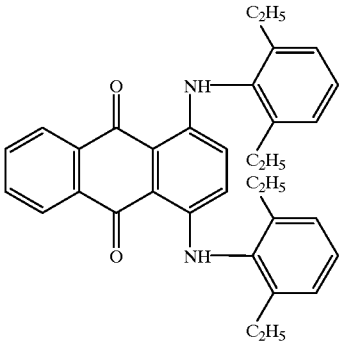

On the sub-layer A-1 side of the support, a photosensitive layer having the following composition was coated so as to have silver coverage of 2.4 g/m$^2$. Photosensitive layer coating solution

| | |
|---|---|
| Photosensitive emulsion | 240 g |
| Sensitizing dye (0.1% methanol solution) | 1.7 ml |
| Pyridinium bromide perbromide (6% methanol solution) | 3 ml |
| Calcium bromide (0.1% methanol solution) | 1.7 ml |
| Oxidizing agent (10% methanol solution) | 1.2 ml |
| 2-(4-Chlorobenzoyl)-benzoic acid (12% methanol solution) | 9.2 ml |
| 2-Mercaptobenzimidazole (1% methanol solution) | 11 ml |
| Tribromethylsulfoquinoline | 17 ml |

-continued

| | |
|---|---|
| (5% methanol solution) | |
| Hydrazine derivative H-26 | 0.4 g |
| Nucleation promoting agent P-51 | 0.3 g |
| Phthalazinone | 0.6 g |
| 4-Methylphthalic acid | 0.25 g |
| Tetrachlorophthalic acid | 0.2 g |
| Calcium carbonate (av. Size of 3 $\mu$m) | 0.1 g |
| A-4 (20% methanol solution) | 20.5 ml |
| Isocyanate compound (Desmodur N3300, Available from Movey Corp.) | 0.5 g |
| Potasium ethyl(α-cyano-β-hydroxyacrylate) | 0.5 g |

Sensitizing Dye

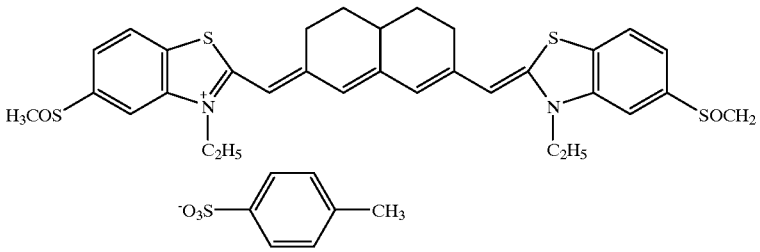

Oxidizing Agent

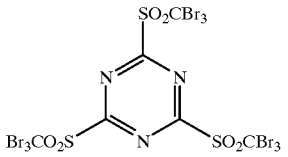

Surface Protective Layer Coating Solution

The following composition was coated on the photosensitive layer simultaneously therewith.

| | |
|---|---|
| Acetone | 5 ml/m$^2$ |
| Methyl ethyl ketone | 21 ml/m$^2$ |
| Cellulose acetate | 2.3 g/m$^2$ |
| Methanol | 7 ml/m$^2$ |
| Phthalazinone | 250 mg/m$^2$ |
| Developer (20% methanol solution) | 10 ml/m$^2$ |
| Matting agent, monodisperse silica having monodispersity of 10% and a mean size of 4 $\mu$m | 5 mg/m$^2$ |
| $CH_2{=}CHSO_2CH_2CH_2OCH_2CH_2SO_2CH{=}CH_2$ | 35 mg/m$^2$ |
| Surfactant $C_{12}F_{25}(CH_2CH_2O)_{10}Cl_2F_{25}$ | 10 mg/m$^2$ |
| $C_9H_{19}{-}C_6H_4{-}SO_3Na$ | 10 mg/m$^2$ |

After removing binder of each of Samples 101 to 105 which were coated on supports of different thickness, electronmicroscopic observation by the replica method proved that organic salt grains were monodisperse grains of a monodisperse degree of 5% and 90% of the total grains were accounted for by tabular grains having a major axis of 0.5±0.05 $\mu$m, a minor axis of 0.4±0.05 $\mu$m and a thickness of 0.01 $\mu$m.

The thus coated five kinds of photothermographic materials were each made into a roll form of 590 mm×61 m and packaged in an ambient light handleable form.

Evaluation

Photothermographic material samples were each evaluated with respect to dimensional change according to the following procedure.

1) Dimension Before Thermal Development

Samples in each roll were each cut into 20 sheets of 610 mm in length. Cutting accuracy for each of the 20 sheets was measured by a length measuring machine. It was proved that the cutting accuracy was within +0.001% and the average length was 610 mm. Measurement was conducted at 23° C. and 55% RH after being allowed to stand for 3 hrs. and imagesetter FT-290R (available from NIHON DENKI Corp.) was used.

A thermal developing machine was used, in which thermal developing machine Dry View Processor 2771 was modified so that the upper roller-mounting position was variable to adjust the ratio of rs/ps. FIG. 1 shows sectional view of this constitution. Thus, it can be seen that it is comprised of opposed metal heat-blocks B with built-in opposed heating rollers C. Photothermographic material is transported by these heated metal rollers. There is provided an apparatus of raising or lowering the level of the central axis of heating roller C (in which arrow "h" indicates the adjustable range), whereby the contact length of a photothermographic material (rs) can be adjusted. In the Figure, A is a casing covering the whole development section, B is a heat-block for heating and C are plural opposed rollers in direct contact with a photothermographic material and built into the heat-block. Photothermographic material sheet S is introduced through an inlet denoted by I to the thermal development section in the direction denoted by an arrow and discharged from an outlet denoted by E. After being discharged, the photothermographic material sheet is transported to a cooling section by urethane transport roller D. Herein, the length within which the photothermographic material is between heat-blocks (denoted by "ps") is defined to be the path length of the thermal development section. In Example 1, the ratio, rs/ps was 0.30.

2) Dimension After Development

Photothermographic material samples, which were cut to a length of 610 mm based on KX-J237LZ were each processed by the thermal developing machine described above. The photothermographic material samples had been allowed to stand under an environment of 23° C. and 55% RH for 3 hrs. and then the length thereof was measure by the length measuring machine. Thereafter, the samples were subjected to thermal development. Thermal development was conducted at 112° C. and a line-speed of 13.7 mm/sec. The average value of measured lengths of 20 sheets of each of thermally developed samples is donated as the length after development, a, as shown in Table 1. Form this after-development length, a and 610 mm of a length before development (which is denoted as b) was determine a degree of elongation or shrinkage caused by thermal development, which was calculated by the equation of [(a/b)−1]×100 (%), as shown in Table 1.

3) Support Thickness

The thickness of the support was determined from electronmicrographs in which the section of the support was magnified to 500 times.

TABLE 1

| Sample No. | Support Thickness ($\mu$m) | Length After Development (mm) | Degree of Elongation (%)* |
|---|---|---|---|
| 101 | 100 | 607.5 | −0.41 |
| 102 | 110 | 608.2 | −0.30 |
| 103 | 120 | 609.1 | −0.15 |
| 104 | 150 | 609.2 | −0.13 |
| 105 | 175 | 609.3 | −0.11 |

*[(a/b) − 1] × 100 (%)

Degree of Elongation or Shrinkage in Image Processing

Software for image processing was prepared and based on the degree of elongation or shrinkage calculated from lengths before and after development (i.e., 610 mm and "a"), as shown in Table 1, a correction factor (%) in image processing for the degree of elongation or shrinkage was set to make corrections for the image size to be exposed and corrections were executed, as shown in Table 2.

To confirm effects of exposure correction, the following experiments were carried out.

5) Image Dimension

Samples 101 to 105 were each exposed through register marks at a 490 mm interval in the roll-winding direction. The register mark was set to be 25 $\mu$m in width. Onto the site to be exposed with the resister mark (i.e., two sites) of each sample, a silver halide emulsion was coated in an area of 1 cm$^2$ so as to result in a dry thickness of 2 $\mu$m. After exposure, only these sites were slightly coated with a developer solution using a writing brush, after removing moisture with Kim-wipes (absorbent paper), a fixer solution was coated and then moisture was again removed with Kim-wipes. This procedure was conducted for the five sheets of each sample and after being allowed to stand in an atmosphere of 23° C. and 55% RH, the length between the resister marks was measured by a length measuring machine. As a result, it was proved that the average of five sheets was 490 mm and a setting error between resister marks was within ±0.001%, which was sufficient to determine a dimensional change after thermal development.

6) Image Dimension After Development

Five sheets of each photothermographic material sample, which were exposed with the register mark set as above were subjected to thermal development under the same condition as described above (i.e., at a developing temperature of 112° C. and a line-speed of 13.7 mm/sec.). In Experiment 1, Sample 101 was thermally developed, as a comparative experiment, without making corrections of an image size to-be exposed, as described in 4). In Experiments 2 to 6, the percentage of elongation or shrinkage in image processing was set from the previously measured degree of elongation or shrinkage (as shown in Table 1), with respect to Samples 101 to 105, as shown in Table 2, after which thermal development was conducted. After the thus thermally developed photothermographic materials were allowed to stand at 23° C. and 55% RH for 3 hrs., the average value of measured lengths of five sheets was shown, as the image dimension after development (represented by mm), in Table 2.

7) Δ(image dimension): a value of a dimension before development (i.e., length between resister marks of 490.0 mm) minus a dimension after development (length between resister marks) was shown in Table 2.

8) Difference Between the Maximum and Minimum Values After Development

With respect to the length between register marks, the difference between the maximum and minimum values among five developed sheets of each sample were determined to evaluate the reproducibility thereof, as shown as "Difference" in Table 2. A difference of about 50 μm is an acceptable level in terms of reproducibility.

9) Number of Tracking Trouble

When 100 sheets in 590 mm×610 mm of each photothermographic material sample were subjected to thermal development at 110° C. and at a line-speed of 13.7 mm/sec, the sheet number of tracking troubles occurring in the thermal developing machine was measured, taking into account the fact that a thicker base support more easily causes tracking troubles.

The results are shown in Table 2. The PET support used in the photothermographic material samples exhibited a glass transition temperature of 78° C.

TABLE 2

| Experiment No. | Sample No. | Correction factor (%) | Dimension After Development | Δ (image dimension) | Difference (μm ) | Tracking Trouble (per 100 sheets) | Remark |
|---|---|---|---|---|---|---|---|
| 1 | 101 | 0.00 | 488.0 | −2.0 | 100 | 8 | Comp. |
| 2 | 101 | 0.40 | 489.9 | −0.1 | 90 | 7 | Inv. |
| 3 | 102 | 0.30 | 489.9 | −0.1 | 40 | 3 | Inv. |
| 4 | 103 | 0.15 | 490.0 | 0.0 | 30 | 0 | Inv. |
| 5 | 104 | 0.15 | 490.1 | 0.1 | 50 | 2 | Inv. |
| 6 | 105 | 0.10 | 489.9 | 0.0 | 80 | 6 | Inv. |

As is apparent from Table 2, Experiment 1, in which no correction for thermal dimensional change of images was made, exihibited marked difference in image dimension between before and after development. In Experiments 2 to 6, in which the correction was made, the image dimension remained unchanged after development in terms of the average value (i.e., remained within ±0.1 mm). Further, fluctuation in each experiment was within acceptable levels for practical use, in view of the difference between the maximum and minimum values.

Example 2

Photothermographic material Samples 201 through 213, as shown in Table 3 were prepared similarly to Example 1, provided that after sub-coating, supports of 100, 120 or 175 μm thickness were subjected to the thermal treatment described below.

10) Thermal Treatment of Support

The support used in Sample 209, after sub-coating, was allowed to stand in a roll form in an atmosphere of 85° C. and 10% RH for 2 days. In all cases except for Sample 209, the temperature in the drying zone at the time of subbing is as "Treatment Temp." shown in Table 3 and the time of passing through the zone is denoted as "Treatment Time" shown in Table 3. The zone of the treatment temperature shown in Table 3 was provided in the latter part of the drying zone.

Using these samples, the degree of elongation or shrinkage (%) of each photothermographic material was determined, as shown in Table 3.

TABLE 3

| Sample No. | Treatment Temp. (° C.) | Treatment Time (sec) | Support Thickness (pin) | Length After Development | Degree of Elongation* |
|---|---|---|---|---|---|
| 201 | — | — | 100 | 607.5 | −0.41 |
| 202 | 60 | 60 | 100 | 607.5 | −0.41 |
| 203 | 80 | 60 | 100 | 608.5 | −0.25 |
| 204 | 110 | 20 | 100 | 607.7 | −0.38 |
| 205 | 110 | 30 | 100 | 609.0 | −0.16 |
| 206 | 110 | 300 | 100 | 608.4 | −0.26 |
| 207 | 160 | 60 | 100 | 608.4 | −0.26 |
| 208 | 200 | 60 | 100 | 612.5 | 0.41 |
| 209 | 85 | 2 days | 100 | 608.8 | −0.20 |
| 210 | 110 | 30 | 120 | 609.2 | −0.13 |
| 211 | 110 | 80 | 120 | 609.4 | −0.10 |
| 212 | 110 | 30 | 175 | 608.9 | −0.18 |
| 213 | 110 | 80 | 175 | 609.0 | −0.16 |

*[(a/b) − 1] × 100 (%)

Similarly, correction factor (%) in image processing was determined from the degree of elongation or shrinkage and the exposure correction experiment was carried out using photothermographic material samples. No correction was made in Experiments 2-1 and 2-2. Results thereof are shown in Table 4.

TABLE 4

| Experiment No. | Sample No. | Correction factor (%) | Dimension After Development | Δ (image dimension) | Difference (μm ) | Tracking Trouble (per 100 sheets) | Remark |
|---|---|---|---|---|---|---|---|
| 2-1 | 201 | 0.00 | 488.0 | −2.0 | 100 | 8 | Comp. |
| 2-2 | 202 | 0.00 | 488.0 | −2.0 | 100 | 8 | Comp. |
| 2-3 | 203 | 0.25 | 489.2 | −0.8 | 60 | 8 | Inv. |
| 2-4 | 204 | 0.40 | 490.2 | 0.2 | 90 | 8 | Inv. |
| 2-5 | 205 | 0.15 | 489.5 | −0.5 | 40 | 8 | Inv. |
| 2-6 | 206 | 0.25 | 489.5 | −0.5 | 50 | 8 | Inv. |
| 2-7 | 207 | 0.25 | 489.6 | −0.4 | 50 | 8 | Inv. |
| 2-8 | 208 | −0.40 | 490.4 | 0.4 | 80 | 8 | Inv. |
| 2-9 | 209 | 0.20 | 489.4 | −0.6 | 60 | 8 | Inv. |
| 2-10 | 210 | 0.15 | 490.2 | 0.2 | 30 | 0 | Inv. |
| 2-11 | 211 | 0.10 | 489.9 | −0.1 | 20 | 0 | Inv. |
| 2-12 | 212 | 0.20 | 490.3 | 0.3 | 50 | 5 | Inv. |
| 2-13 | 213 | 0.15 | 489.3 | −0.7 | 50 | 5 | Inv. |

Effects of correction are apparent. It is further proved that samples with a support having been subjected to thermal treatment had less difference between the maximum and minimum values after development, exhibiting less fluctuation among development lots, compared to samples with a support having no thermal treatment. However, when the treatment temperature was too high (Sample 208), fluctuation was slightly increased. Other samples were at acceptable levels in fluctuation.

Example 3

Samples 301 through 308 were similarly prepared, provided that the thickness of the support or thermal treatment conditions were varied, as shown in Table 5.

Samples were subjected to thermal development under the conditions shown in Table 5, in which the developing temperature was varied in the thermal developing machine and rollers were moved to vary the ratio of rs/ps. Thus, Experiments 3-1a through 3-18a were carried out similarly to Example 1 to determine the thermal dimensional change. The obtained degree of elongation or shrinkage (in %) is shown in Table 5.

Herein, "ps", that is, a path length in the thermal developing section is defined as the length of a photothermographic material located in the thermal developing section when the photothermographic material is allowed to be located in the overall developing section; "rs", that is, the contact length in the transport direction with all transport roller(s) and/or all heating roller(s) in the thermal developing section is defined as the total length in the transport direction, in which the photosensitive layer side and the backing layer side are both in contact with a heated roller and a transport roller in the developing section. In cases where the number of the heated roller or transport roller is plural, it is the sum thereof.

TABLE 5

| Experiment No. | Sample No. | Treatment Temp. (° C.) | Treatment Time (sec) | Support Thickness (μm) | Length After Development | Developing Temp. (° C.) | rs/ps | Degree of Elongation* |
|---|---|---|---|---|---|---|---|---|
| 3-1a | 301 | — | — | 100 | 607.8 | 110 | 0.20 | −0.36 |
| 3-2a | 301 | — | — | 100 | 607.4 | 110 | 0.02 | −0.43 |
| 3-3a | 301 | — | — | 100 | 607.6 | 110 | 0.05 | −0.39 |
| 3-4a | 301 | — | — | 100 | 607.8 | 110 | 0.20 | −0.36 |
| 3-5a | 301 | — | — | 100 | 607.8 | 110 | 1.00 | −0.36 |
| 3-6a | 301 | — | — | 100 | 607.3 | 110 | 1.40 | −0.44 |
| 3-7a | 301 | — | — | 100 | 607.2 | 110 | 1.70 | −0.46 |
| 3-8a | 301 | — | — | 100 | 608.0 | 90 | 0.20 | −0.33 |
| 3-9a | 301 | — | — | 100 | 608.0 | 100 | 0.20 | −0.33 |
| 3-10a | 301 | — | — | 100 | 607.7 | 150 | 0.20 | −0.38 |
| 3-11a | 301 | — | — | 100 | 607.6 | 180 | 0.20 | −0.39 |
| 3-12a | 302 | — | — | 120 | 609.5 | 110 | 0.20 | −0.08 |
| 3-13a | 303 | — | — | 150 | 609.2 | 110 | 0.20 | −0.13 |
| 3-14a | 304 | — | — | 175 | 609.2 | 110 | 0.20 | −0.13 |
| 3-15a | 305 | 60 | 80 | 100 | 607.9 | 110 | 0.20 | −0.34 |
| 3-16a | 306 | 110 | 80 | 100 | 609.2 | 110 | 0.20 | −0.13 |
| 3-17a | 307 | 190 | 80 | 100 | 609.0 | 110 | 0.20 | −0.16 |
| 3-18a | 308 | 110 | 80 | 120 | 609.8 | 110 | 0.20 | −0.03 |

*[(a/b) − 1] × 100 (%)

Similarly to Example 1, Experiments 3-1b through 3-18b were carried out, in which thermal development was conducted, while the correction factor (in %) in image processing was set so as to meet a thermal dimensional change (i.e., degree of elongation or shrinkage) of each sample. Results thereof are shown in Table 6. Further, samples were each exposed using imagesetter FT-290R with stepwise varying exposure at 0.1 logE intervals to determine sensitivity. The sensitivity was represented by a relative value, based on the sensitivity of the sample of Experiment 3-1b being 100. Thermal development was conducted at 112° C. and at a line-speed of 13.7 mm/sec. In Experiment 3-11b, sensitivity could not be determined since the sheet was fully blackened.

TABLE 6

| Experiment No. | Sample No. | Developing Temp. (° C.) | rs/ps | Correction factor (%) | Dimension After Development | Δ (image dimension) | Difference (μm ) | Sensitivity | Tracking Trouble (100 sheets) | Remark |
|---|---|---|---|---|---|---|---|---|---|---|
| 3-1b | 301 | 110 | 0.20 | 0.00 | 488.0 | −2.0 | 100 | 100 | 8 | Comp. |
| 3-2b | 301 | 110 | 0.02 | 0.45 | 490.3 | 0.3 | 100 | 95 | 8 | Inv. |
| 3-3b | 301 | 110 | 0.05 | 0.40 | 490.2 | 0.2 | 80 | 98 | 7 | Inv. |
| 3-4b | 301 | 110 | 0.20 | 0.35 | 489.8 | −0.2 | 60 | 100 | 9 | Inv. |
| 3-5b | 301 | 110 | 1.00 | 0.35 | 489.7 | −0.3 | 70 | 105 | 9 | Inv. |
| 3-6b | 301 | 110 | 1.40 | 0.45 | 490.2 | 0.2 | 70 | 106 | 8 | Inv. |
| 3-7b | 301 | 110 | 1.70 | 0.45 | 489.7 | −0.3 | 80 | 110 | 10 | Inv. |
| 3-8b | 301 | 90 | 0.20 | 0.35 | 490.3 | 0.3 | 90 | 70 | 8 | Inv. |
| 3-9b | 301 | 100 | 0.20 | 0.35 | 490.3 | 0.3 | 70 | 95 | 7 | Inv. |
| 3-10b | 301 | 150 | 0.20 | 0.40 | 490.4 | 0.4 | 70 | 102 | 9 | Inv. |
| 3-11b | 301 | 180 | 0.20 | 0.40 | 490.3 | 0.3 | 80 | — | 10 | Inv. |
| 3-12b | 12 | 110 | 0.20 | 0.10 | 490.1 | 0.1 | 20 | 100 | 0 | Inv. |
| 3-13b | 13 | 110 | 0.20 | 0.15 | 490.3 | 0..3 | 30 | 99 | 2 | Inv.. |
| 3-14b | 14 | 110 | 0.20 | 0.15 | 490.3 | 0.3 | 40 | 95 | 5 | Inv. |
| 3-15b | 15 | 110 | 0.20 | 0.35 | 490.1 | 0.1 | 60 | 100 | 7 | Inv. |
| 3-16b | 16 | 110 | 0.20 | 0.15 | 490.1 | 0.1 | 20 | 100 | 7 | Inv. |
| 3-17b | 17 | 110 | 0.20 | 0.15 | 489.7 | −0.3 | 60 | 100 | 8 | Inv. |
| 3-18b | 18 | 110 | 0.20 | 0.05 | 490.0 | 0.0 | 10 | 100 | 0 | Inv. |

Effects of the image correction were apparent. It was also proved that when the value of rs/ps or the developing temperature was outside the preferred range, fluctuation increased.

Effect of the Invention

When photothermographic materials are employed in printing, adjustment of exposure areas for thermal dimensional change caused by thermal development minimizes variation of image sizes upon development, minimizing doubling occurred in printing.

Disclosed embodiments can be varied by a skilled person without departing from the spirit and scope of the invention.

What is claimed is:

1. An image forming method of a photothermographic material by an image forming apparatus comprising:

inputting an image data to the image forming apparatus;

processing the inputted image data or setting an exposure condition so that, if the photothermographic material elongates by thermal development in a thermal developing section of the image forming apparatus, an exposed image size is allowed to be reduced according to the elongation of the photothermographic material; or if the photothermographic material shrinks by thermal development in the thermal developing section of the image forming apparatus, an exposed image size is allowed to be enlarged according to the shrinkage of the photothermographic material; imagewise exposing the photothermographic material to a laser to form an image based on the processed image data or the set exposure condition; and subjecting the exposed photothermographic material to thermal development; wherein, the photothermographic material comprises an organic silver salt, a photosensitive silver halide, a reducing agent, and a contrast increasing agent or a quaternary onium salt.

2. The image forming method of claim 1, wherein the photothermographic material has a 110 to 150 μm thick support.

3. The image forming method of claim 1, wherein the photothermographic material has a support, the support being allowed to stand for at least 30 seconds in an atmosphere at a temperature of not less than a glass transition temperature of the support (Tg) and not more than Tg plus 100° C. after being cast and stretched and before being exposed.

4. The image forming method of claim 1, wherein the processing temperature in a thermal developing section is from 100 to 150° C., and a ratio of a contact length in a transporting direction of the photothermographic material with roller(s) (rs) to a path length of the thermal developing section (ps), rs/ps is 0.04 to 1.4.

5. The image forming method of claim 1, wherein the exposed image size is enlarged or reduced at a level of 0.01% to 0.1% on the basis of an image size of the inputted image data.

6. An image forming method of a photothermographic material by an image forming apparatus comprising:

inputting an image data to the image forming apparatus;

processing the inputted image data or setting an exposure condition to reduce or enlarge an exposed image size taking into account non-uniformity in temperature inside a thermal developing section of the image forming apparatus so that non-uniformity in thermal development is reduced;

imagewise exposing the photothermographic material to a laser to form an image based on the processed image data or the set exposure condition; and subjecting the exposed photothermographic material to thermal development;

wherein the photothermographic material comprises an organic silver salt, a photosensitive silver halide, a reducing agent, and a contrast increasing agent or a quaternary onium salt.

* * * * *